US005857545A

United States Patent [19]

Barrett et al.

[11] Patent Number: 5,857,545

[45] Date of Patent: Jan. 12, 1999

[54] ELEVATOR SYSTEM WITH OVERLAPPED ROPED-COUPLER SEGMENTS

[75] Inventors: David W. Barrett, East Hartland; John F. Cassidy, Jr., Avon; George A. L. David, West Hartland; Ernest P. Gagnon, Manchester; Richard E. Peruggi, Glastonbury, all of Conn.

[73] Assignee: Otis Elevator Company, Farmington, Conn.

[21] Appl. No.: 822,202

[22] Filed: Mar. 20, 1997

[51] Int. Cl.[6] ..... B66B 9/00

[52] U.S. Cl. ..... 187/249; 187/257; 187/404

[58] Field of Search ..... 187/249, 257, 187/256, 404, 414, 382, 383

[56] References Cited

FOREIGN PATENT DOCUMENTS 3-177293 8/1991 Japan .
4-341479 11/1992 Japan .
9-30756 2/1997 Japan .
2270292 3/1994 United Kingdom ..... 187/404

*Primary Examiner*—Kenneth Noland

[57] ABSTRACT

An elevator system has a plurality of elevator cars traveling upwardly in one hoistway and downwardly in an adjacent hoistway, the cars being propelled in a series of overlapping segments, each segment including a pair of couplers roped to counterweights and driven by elevator traction machines. A variant uses a closed loop rope with a pair of couplers to transfer elevator cars from a counterweighted coupler of one segment to a counterweighted coupler of an adjacent segment. An upper passenger landing moves cars on overhead trolleys and a lower passenger landing moves cars on dollies to take them from a hoistway through unloading and loading stations and back to another hoistway. The elevator car roller guides are releasable to permit lateral movement of cars to and from landings. A latched spring buffer and/or a LEM decelerate and accelerate unbalanced counterweights.

8 Claims, 19 Drawing Sheets

250
320
321
322
323
325
327
A
B
C
D
E
F
G
H
I

ELEVATOR SYSTEM WITH OVERLAPPED ROPED-COUPLER SEGMENTS

TECHNICAL FIELD

This invention relates to an elevator system for a hypertall building in which a plurality of cars are moved continuously in an up hoistway and in a down hoistway by a series of overlapped hoisting mechanisms, each including a car coupler roped to a hoisting machine.

BACKGROUND ART

In hypertall buildings, it has been known to move passengers to the highest parts of the building by means of a series of elevators, the lower elevator taking the passengers to a first sky lobby, after which the passengers walk to another elevator for travel to a second sky lobby; thereafter, passengers may disperse in local elevators or travel in yet a third elevator to an additional sky lobby. The taller a building becomes, the more difficult it is to find sufficient space for elevators to move the requisite number of passengers to the higher ends of the building. Thus, it becomes more important with additional height that the use of the elevator core space be very efficient.

Another problem with hypertall buildings is that the weight of the elevator rope (the steel cables that support the car and the counterweight) preclude use of rope systems beyond about one hundred twenty floors, or so. Another problem with conventional elevators is that only one elevator can occupy an elevator hoistway at a time since it must be continuously roped to its counterweight, and since it reciprocates, up and down, in the hoistway.

It is suggested to overcome some of these problems by the use of elevators powered by linear electric motors (LEMs), which provide driving force to the elevator car directly from the building structure. However, without a counterweight, the size and power requirements for LEMs suitable to move elevator cars are at the present prohibitive for practical service.

In copending U.S. patent application Ser. No. 8/564,754, filed Nov. 29, 1995 now U.S. Pat. No. 5,657,835, an elevator cab travels in a car frame in one hoistway to a transfer floor where the car frame stops; the cab is moved to a car frame in an adjacent hoistway for further travel.

DISCLOSURE OF INVENTION

Objects of the present invention include eliminating the need to limit the height of elevator service as a consequence of elevator support rope weight, providing a readily achievable elevator system in which more than one elevator car can travel in a hoistway at a given time, and provision of an improved, highly effective elevator system for hypertall buildings. Another object is to eliminate the need for stopping and transferring a cab during an elevator run.

According to the present invention, a plurality of pairs of roped car couplers extend between service levels of a building, each pair of car couplers traveling in adjacent paths which vertically overlap the adjacent paths of other pairs, each of the couplers selectively coupling the rope to a car. Each coupler moves in alternate down and up directions, first coupled to a car heading up, and then coupled to a car heading down, to advance successive cars coupled thereto in alternate up and down directions in synchronism with the other pairs, there being one car per pair in the system.

In further accord with the invention, the car couplers are roped through a hoisting machine to a counterweight.

In one embodiment, as the car nears the end of one of the segments, it is coupled to the rope of the next segment in the direction of car travel, and then it is decoupled from the rope which had been advancing it. The decoupled rope decelerates, waits, reverses direction and accelerates so as to become coupled to an oppositely-moving car. The rope of each pair is sequentially coupled to a car in an up running hoistway, uncoupled (for direction reversal), and then coupled to a car in a down-running hoistway, as the other rope of the pair is substantially simultaneously alternately coupled to a car in a down-running hoistway, uncoupled, reversed, and then coupled to a car in an up-running hoistway.

In another embodiment, a LEM powered shuttle having a pair of couplers receives each car from a roped coupler and advances it to the next roped coupler, two cars at a time, one traveling up, the other traveling down so as to counterbalance each other.

The highest and lowest of said pairs of roped couplers decelerate while coupled to the cars so as to stop cars at passenger service levels for exchanging passengers.

In further accord with the invention, cars that come to rest at service levels of the building are decoupled from the hoisting mechanisms, removed from the hoistways and directed to passenger lobbies to permit passengers to exit and enter the cars. In still further accord with the invention, the removal of one car from one hoistway is matched by a substantially simultaneous return of another car into the other hoistway.

According to the invention, a latched spring buffer to absorb the energy of a downwardly traveling counterweight after a car has been decoupled therefrom, to store that energy, and to use that energy to accelerate the counterweight upwardly when it is to become coupled to a downwardly traveling car. Preferably, a LEM may be disposed on the counterweight to assist in precise control of the acceleration, to match the speed of the car. In another embodiment, LEMs may decelerate and accelerate the unbalanced counterweights, without a latched spring buffer.

According to the invention, LEMs associated with the counterweights control the exact acceleration/deceleration and positioning thereof, so that they may be coupled in synchronous fashion to cars which are traveling in the upwardly or downwardly direction.

The invention may be practiced utilizing a self-retaining coupler having a retaining surface tilted at a first moderate angle, the engagement and disengagement of which is accomplished by moving the coupler along a path which is at a significantly greater angle than the angle of the contact surface.

Other objects, features and advantages of the present invention will become more apparent in the light of the following detailed description of exemplary embodiments thereof, as illustrated in the accompanying drawing.

BEST MODE FOR CARRYING OUT THE INVENTION

Figures 1, 2, 3, 4, 5:
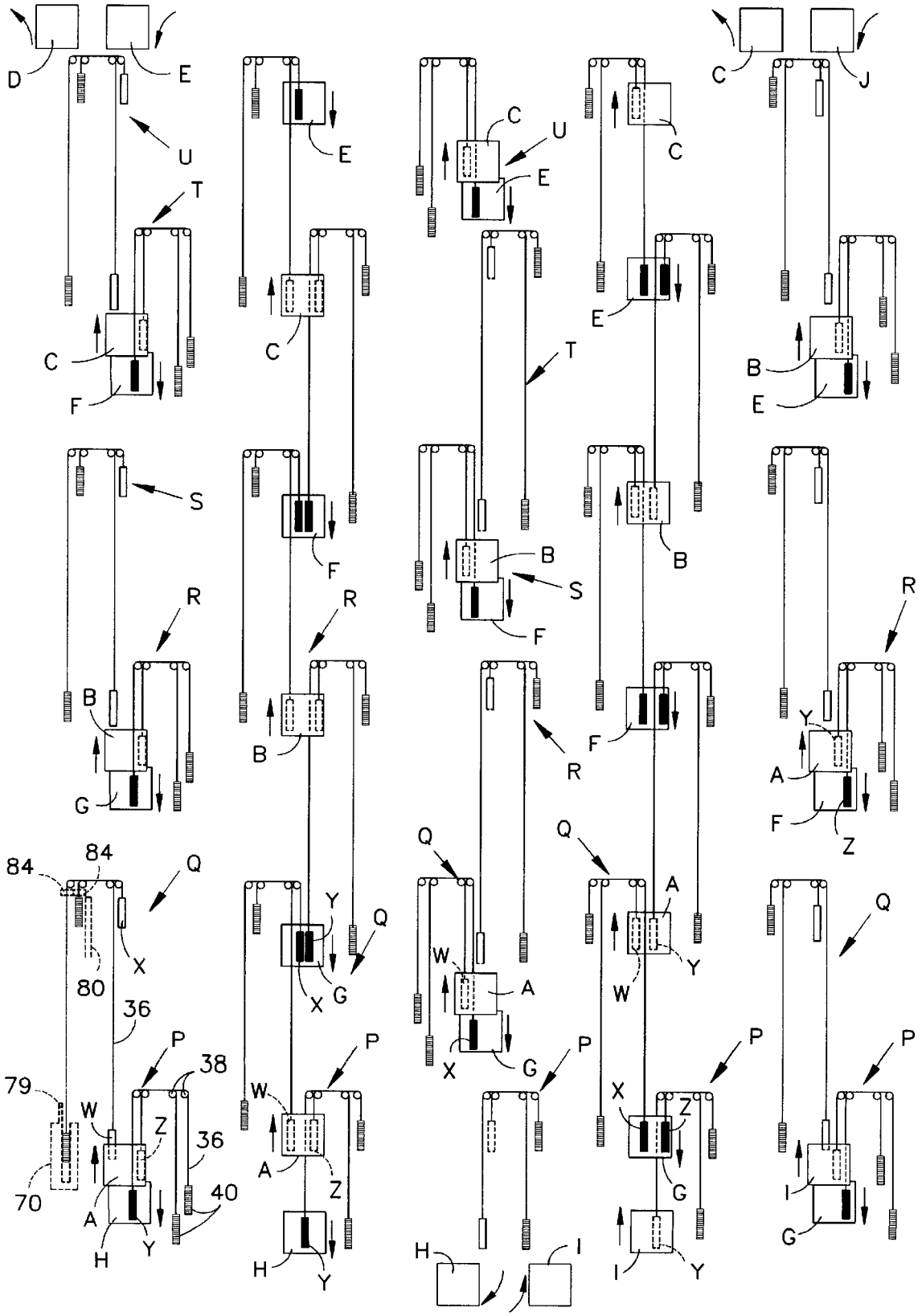
FIGS. 1–5 are simplified, stylized, side elevation views of an elevator system employing six, vertically overlapped pairs of hoisting mechanisms, illustrating progression of elevator cars in the upward and downward directions.

Referring to FIG. 1, a plurality of elevator cars A–J are traveling in an elevator system which has six segments P–U, each of which comprises (FIG. 6) a traction machine 37 driving one or more drive sheaves 38 having the usual brakes 39 for driving a rope 36 extending from a counterweight 40 and a pair of car couplers W, X or Y, Z. In the lowest illustration of FIG. 1, and in FIGS. 6 and 7, the coupling means 41 of the coupler Z is shown coupled to the coupling means 42 of car A and the coupling means 41 of coupler Y is shown coupled to the coupling means 42 of car H. As seen in FIG. 7, each of the couplers W–Z is bidirectional in that it can couple itself to a car in either the up hoistway (car A) or a car in the down hoistway (car H).

In FIGS. 1–5, the up-traveling car (cars A, B and C in FIG. 1) are shown in front of the down traveling cars (cars F, G and H in FIG. 1). The couplers W–Z are between the path of motion of the up traveling car and the path of motion of the down traveling car, referred to as "hoistways". In FIG. 1, car A has been hoisted to nearly the top of segment P by the coupler Z, and car H has been lowered part way along segment P by coupler Y. In FIGS. 1–5, couplers that can be seen in a particular view are shown either as hollow blocks when they are not coupled (X and part of W in the lowest illustration of FIG. 1), solid blocks when they can be seen and are coupled (Y in the lowest illustration of FIG. 1) and dotted blocks (Z in the lowest illustration of FIG. 1) when they cannot be seen and are coupled.

In FIG. 2, car H has been lowered almost to the lower passenger landing (not shown in FIGS. 1–5, but referred to hereinafter). Car A has been raised almost to the top of segment P by coupler Z, and coupler W has also engaged car A. This is a point in time when car A is handed off from segment P to segment Q. It does this on the fly, at a steady, upward speed. In order to properly engage, the coupler W is accelerated in the upward direction in synchronism with the motion of the coupler Z so as to be at the right position and traveling at the correct speed at a predetermined point where coupling is to occur. Once coupling has occurred and has been verified by safeties in the well-known fashion, the coupler Z can be disengaged, in a fashion described hereinafter.

In FIG. 3, the car H has been disconnected from the coupler Y, and is being handled at the lower passenger landing in a manner to be described hereinafter. As soon as coupler Y has stopped, even as car H is being disconnected therefrom, car I can engage the opposite side of the coupler Y for travel in the up hoistway, as described hereinafter. In FIG. 3, car A has been propelled part way along the segment Q by the coupler W, and another car G passes car A in the down hoistway in engagement with the coupler X.

In FIG. 4, the car I is being propelled upwardly in the segment P by the coupler Y, and the car G has been lowered sufficiently on the coupler X so that it is handed off into engagement with the coupler Z of segment P. Car A has been raised sufficiently in segment Q by coupler W so that it is handed off into engagement with coupler Y of segment R. In FIG. 5, upwardly traveling car I passes downwardly traveling car G; and car A continues upwardly in engagement with coupler Y of segment R as car F passes car A in the down hoistway in engagement with coupler Z of segment R. This action continues: each coupler travels in a first direction (up or down) coupled to one car, hands the car off to a coupler in an adjacent segment, decelerates, then accelerates in the opposite direction (down or up) to become coupled with another car traveling in such direction. The coupler again hands the car off to a coupler of the opposite adjacent segment traveling in the second direction and then it stops and reaccelerates once again in the first direction, and so forth. Except for accelerating or decelerating a car at the top or bottom of a hoistway, each car travels upwardly or downwardly at a constant speed, being handed off from the coupler of one segment to the coupler of an adjacent segment heading in the same direction.

Referring to FIG. 7, each of the couplers is confined in a precise vertical path by means of conventional guide rails 43 working in conjunction with conventional guide rollers (not shown) or other guides. In FIG. 7, four guide rails are shown for each coupler, although two guide rails or more may be utilized if desired. The counterweights 40 similarly have conventional guide rails 44 working in conjunction with conventional guide rollers (not shown) or other guides. Each of the cars A, H are also provided with a pair of guide rails 44 working in conjunction with releasable guide rollers 45 or other suitable releasable guides, so as to allow the cars A, H to travel to the front or to the rear so as to be removed from the hoistway onto a passenger landing, all as is described hereinafter. Notice in the embodiment of FIGS. 1–7 that the W and X couplers in one segment (such as Q) will never interfere with the Y and Z couplers in the segments above and below it (such as R and P). In the embodiment of FIGS. 1–7, each segment has both of its couplers and roping systems on the same side of the cab: that is, it either has W and X or it has Y and Z as couplers. However, there is no requirement that this be so, and the segments could alternate between outside couplers (W and Z) in some of the segments, and inside couplers (X and Y) in segments which are interleaved therewith. The lowest and highest segments in the system will generally be shorter to accommodate the time required to decelerate to a stop, and make provisions to remove the car from the hoistway, as well as to return a car to a hoistway and accelerate it.

Figure 8:
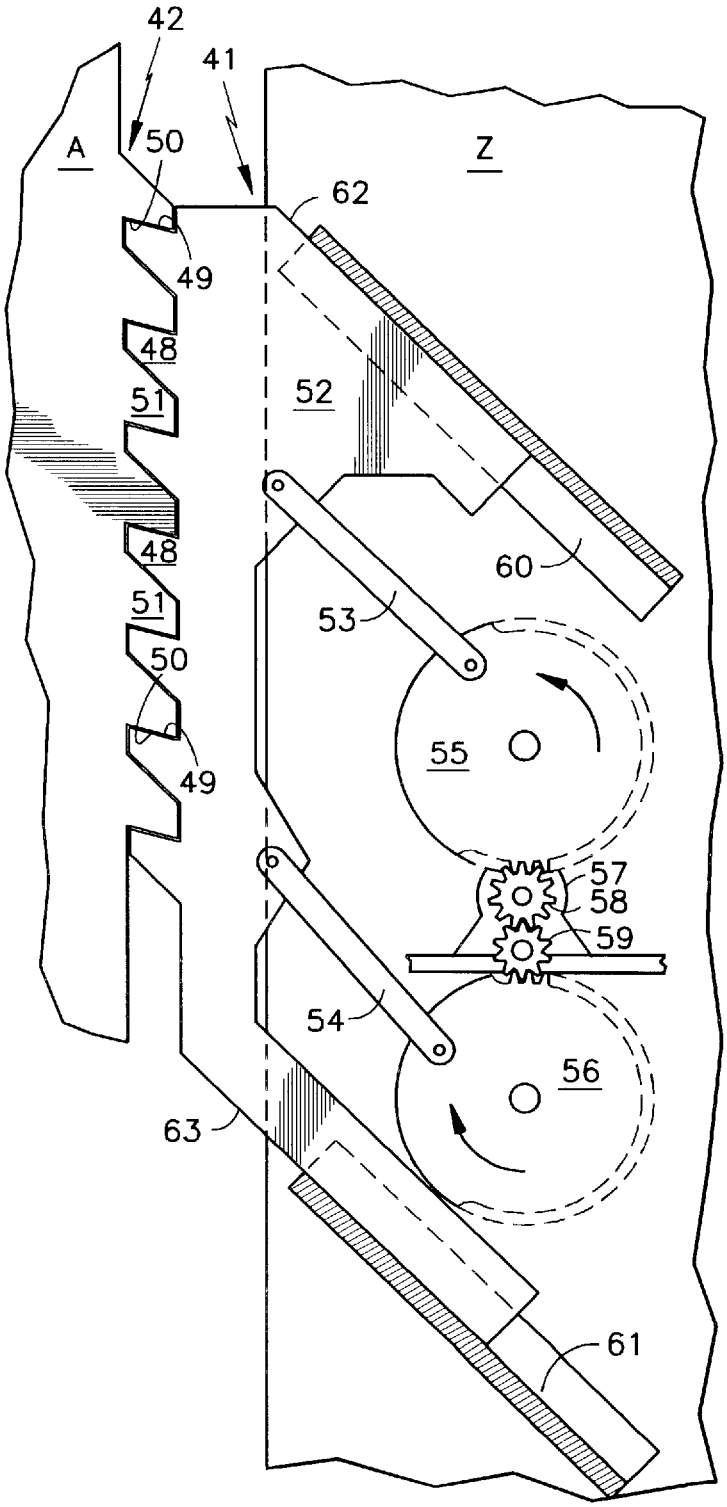
FIG. 8 and 9 are partial, partially sectioned, side elevation views of a coupler for coupling the roped counterweight to the elevator car, in the engaged and disengaged positions, respectively.
Figure 9:
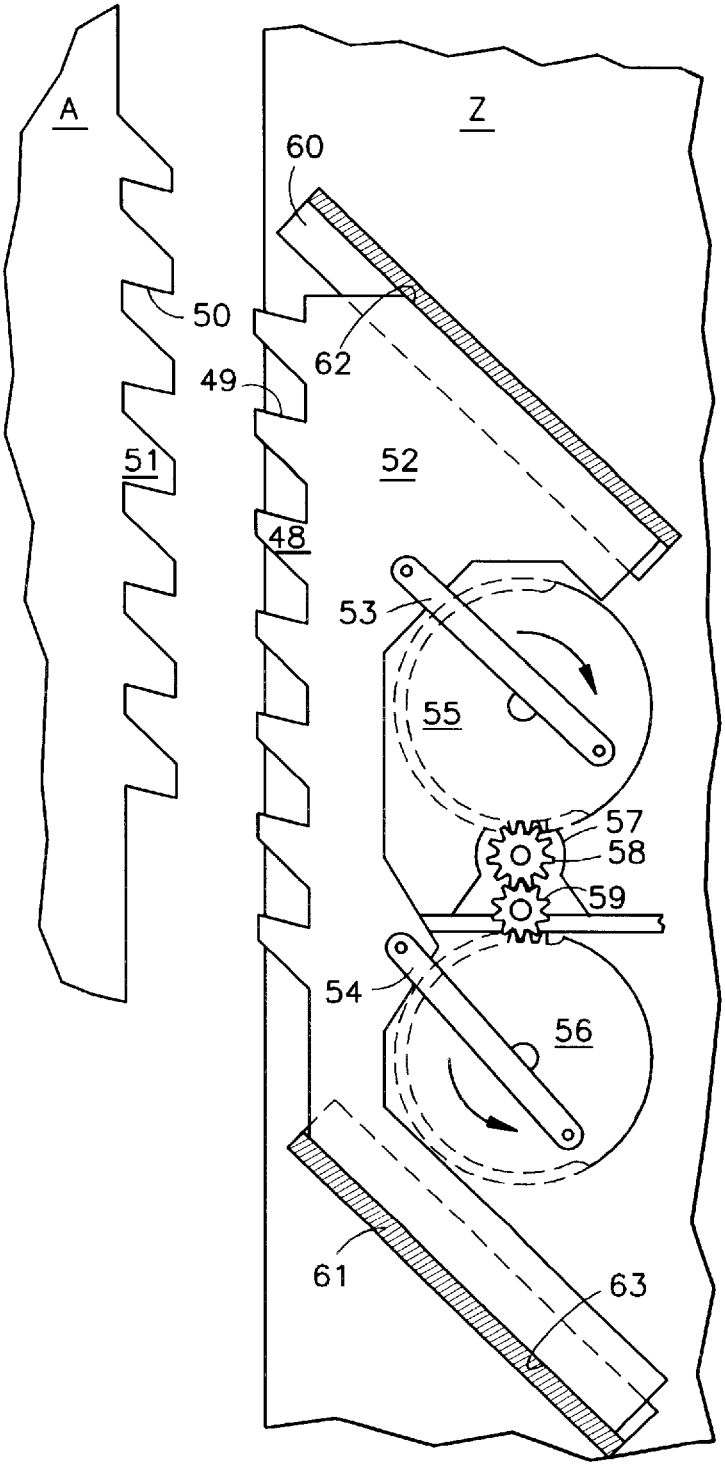

Referring to FIG. 8, one side of coupler Z is illustrated as having a plurality of teeth 48 with engagement surfaces 49 at a moderate inclined angle (relative to the horizontal) which engage corresponding surfaces 50 of teeth 51 on the elevator car, such as car A. The angle of the inclination of the surfaces 49, 50 is sufficient so that with the weight of the car A imposed on the teeth 48, the coupler will remain with the surfaces 49, 50 adjacent each other when in the engaged position shown in FIG. 8. The angle depicted in FIG. 8 is 15°, but it could be some other angle. The teeth 48 are disposed on at least one plate 52 connected by arms 53, 54 to sector gears 55, 56. The gears 55, 56 are driven in opposite directions by a motor 57 having a gear 58 that drives the sector gear 55 and that also drives a pinion gear 59 that drives the sector gear 56. As seen in FIG. 8, rotating the sector gear 55 anti-clockwise while rotating the sector gear 56 clockwise will cause upward and outward motion of the plate 52 as confined by a pair of guide rails 60, 61, into the engaged position as shown. Instead of rotating sector gears, linear actuators, such as hydraulic piston actuators or jack screws could be utilized to advance the plate 52 into the engaged position or alternatively retract it into the disengaged position, shown in FIG. 9. In the disengaged position, the teeth on the couplers will not interfere with the teeth on the cars, so that cars and couplers may move freely when adjacent to each other. In FIGS. 8 and 9, the guides 60, 61 and the corresponding edges 62, 63 of the plate 52 are at an angle (such as about 45°) which is sufficiently greater than the angle of inclination of the surfaces 49, 50 (such as about 15°) so that retraction of the plate 52 (by moving down onto the right in FIG. 8) will allow disengaging the surfaces 49, 50 while the car (such as car A) continues to be moved in the upward or downward direction by a different coupler which has recently been engaged thereto. The bottoms of the teeth 48 will slide along the tops of the teeth 51, since the car weight is handled by the other coupler, but the disengaging coupler continues at the same speed until fully decoupled. Similarly, the surfaces 49 can be brought into engagement with the surfaces 50 by leftward, upward motion, which is at a greater angle (60–63) than the angle of the surfaces 49, 50, as the car (such as car A) is being moved in either the upward or downward direction by a previously engaged coupler. The coupler works in an identical fashion whether the car and coupler are traveling upwardly or downwardly; each of the couplers W–Z has a similar mechanism on the side opposite of that shown in FIGS. 8 and 9. Of course, the broadest aspects of the present invention may be practiced utilizing a coupler different from that described with respect to FIGS. 8 and 9.

Figure 10:
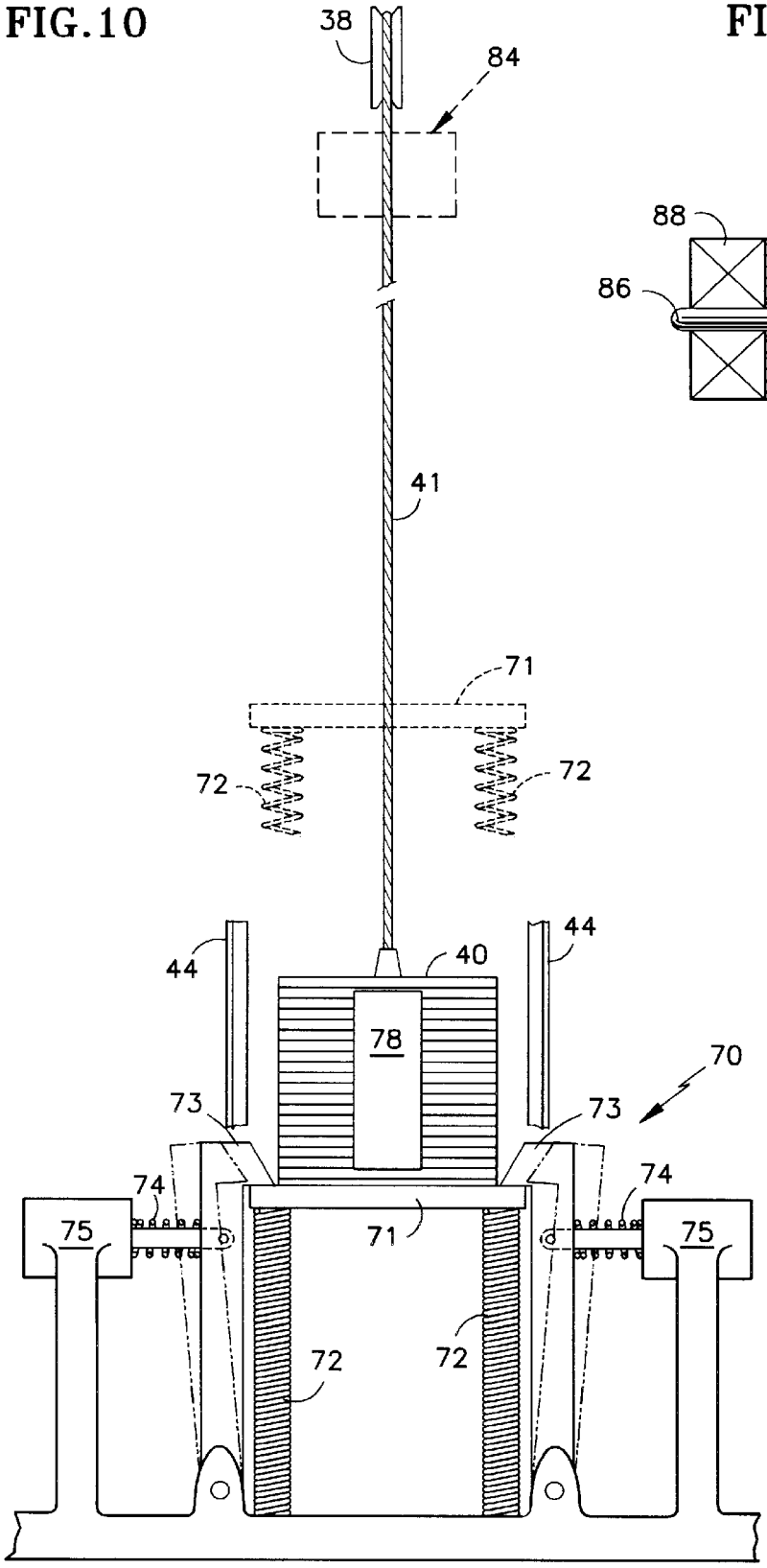
FIG. 10 is a partial, front elevation view of a latched spring buffer for capturing, storing and returning counterweight energy.

Referring now to FIG. 10, a latching, spring buffer 70 includes a platform 71 supported by at least two springs 72 disposed at the extreme bottom end of the path of the counterweight 40 as defined by its guide rails 44. The platform can be held in a position with the springs 72 compressed (as shown) by means of two or more latches 73 which are urged into the latched position, shown by means of springs 74, and which can be retracted so as to release the platform 71 under force of the springs 72 by means of solenoids 75, or other suitable actuators. In operation, as the coupler connected to the particular counterweight 40 is raising an elevator car, eventually that car is engaged by another coupler, and the coupler in question is retracted. At that point in time, there is insufficient downward force on the coupler side of the traction machine so that the traction machine cannot arrest the motion of the counterweight 40. The counterweight 40, will, however, engage the platform 71 in a position shown dotted in FIG. 10 where the springs 72 are fully extended, and compression of the springs will absorb the energy of the decelerating counterweight 40. When the counterweight 40 compresses the springs 72 so that the platform 71 falls below the lips of the latches 73, the latches 73 will engage as shown and prevent the counterweight from oscillating on the springs 72. When it is time to accelerate the related coupler in a downward direction so that it can be engaged with a downwardly traveling car, the solenoids 75 are actuated to release the latches 73 and the springs 72 will launch the counterweight 40 upwardly. Thus, the energy stored during deceleration, in the form of distorted springs, is released during acceleration. Tension (rather than compression) springs, and other resilient distortable members (herein all grouped into the term "spring") may be used. In order to control precisely the position and speed of the related coupler, the counterweight 40 may also be guided by a LEM, the primary winding of which is not shown in FIG. 10, but which would extend essentially from the platform 71 several stories upwardly along the path of the counterweight. The counterweight in turn has a LEM secondary winding 78 disposed thereon. The approximate positioning of the latched buffer 70 and a LEM primary winding 79 are shown in the lowest illustration of FIG. 1. Each of the counterweights in all of the sectors will have some means for decelerating and accelerating the counterweights, such as a LEM similar to that described with respect to FIG. 10. But when traveling upwardly, the counterweights are decelerated by gravity, rendering the latched buffer 70 unnecessary. In some embodiments, it is possible to use just a LEM for decelerating and reaccelerating even the downwardly traveling counterweights, provided the LEM is of a high enough power capacity.

Figure 11:
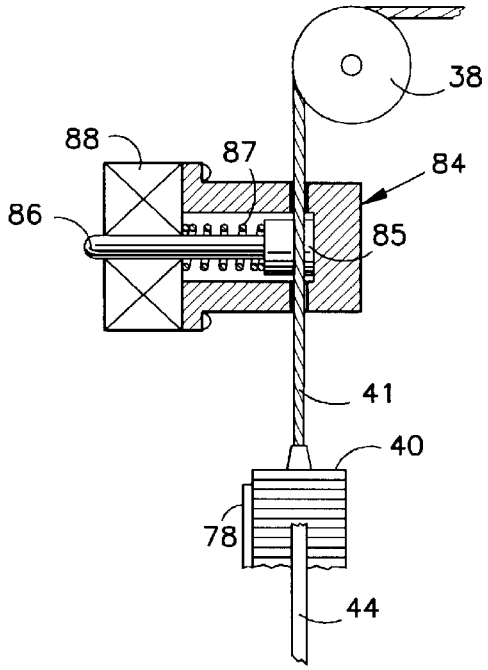
FIG. 11 is a partial, partially sectioned, side elevation view of a rope brake.

Referring to FIG. 11, the counterweight 40 is shown in the extreme uppermost limit of its travel path. In the case of an upwardly traveling counterweight, once the car has been disengaged from the corresponding coupler, the weight will tend to decelerate from gravity, making it unnecessary to utilize a buffer of the type shown in FIG. 10. However, the counterweight may be decelerated in a stabilized manner, and accelerated properly to have the correct position and speed, by means of a LEM, including the LEM secondary winding 78 on the counterweight 40, and a LEM primary winding 80 as illustrated in the lowest portion of FIG. 1. To hold the counterweight 40 in its uppermost position, a brake 84 may grip the rope 41 between an anvil 85 and an armature 86. In a fashion similar to a regular elevator sheave brake, the armature 86 may be urged toward the anvil 85 by a strong spring 87 and the brake released by energizing a solenoid 88 which attracts the armature 86, thereby releasing the grip on the rope 41. Other forms of brakes may be used if desired. In some cases, the invention may be practiced utilizing only the LEM to retain a counterweight in its upward position between deceleration and acceleration. The position of brakes 84 on the segment Q is shown in the lowest illustration of FIG. 1.

Figure 12:
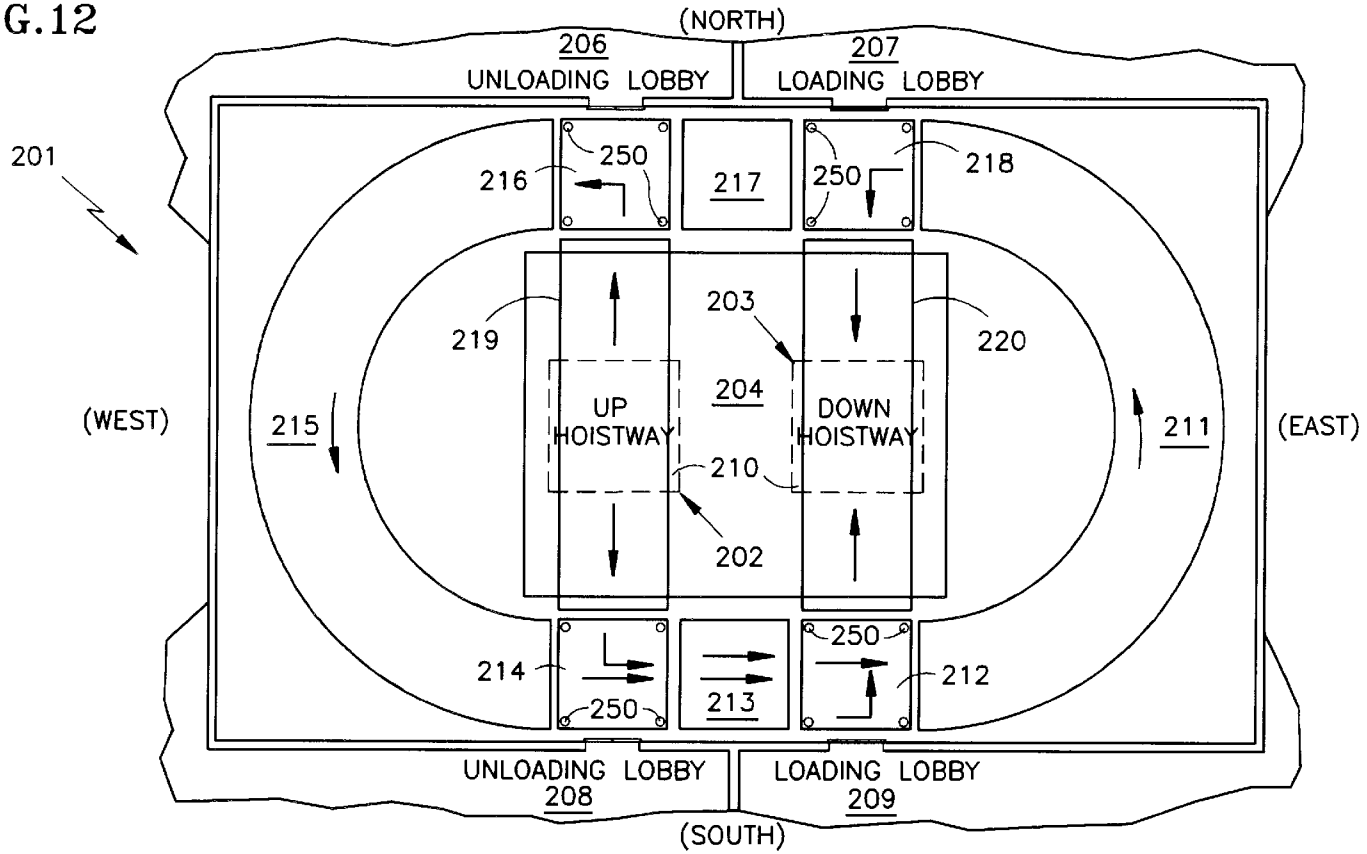
FIG. 12 is a simplified plan view of an upper passenger landing.

Referring now to FIG. 12, an upper passenger landing 201 surrounds an up hoistway 202, a down hoistway 203, and an area 204 around the elevator hoisting mechanisms. It also includes a north unloading lobby 206, a north loading lobby 207, a south unloading lobby 208 and a south loading lobby 209 (where north and south are for convenience, and unrelated to earth coordinates). The elevator cars are moved above the passenger landing 201 on guideways or tracks 211–220 by means of six trolleys, such as a trolley 223 shown straddling the tracks in FIGS. 15 and 17, as described hereinafter. The dotted lines 210 depict the outline of an elevator car when leaving or entering one of the hoistways. Each elevator car traveling up will arrive at the up hoistway, and be moved to one of the unloading lobbies (north, south), where its doors will open and passengers may exit the car. Then the car will be moved to the opposite loading lobby (south, north) where the doors are again opened so that passengers may enter. After the car is loaded and the doors closed, the car is moved to the down hoistway so as to be lowered therein by a hoisting mechanism. Any car can use either the north or south lobbies for unloading and loading, because the cars have two sets of doors. Whenever a car is at a lobby for unloading or loading, it is raised slightly and stabilized by four jacks 250, which are disposed as shown dotted in FIG. 15. This allows the trolley to be released and move on.

Figures 13A, 13B, 13C, 13D, 13E, 13F, 13G, 13H, 13I:
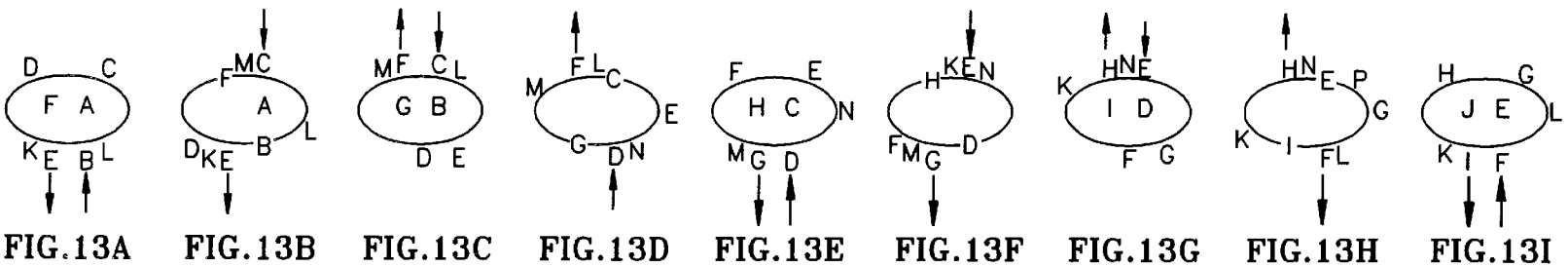
FIG. 13 is a series of illustrations of how the elevator cars proceed, successively, through the passenger landing of FIG. 12.
Figure 14A:
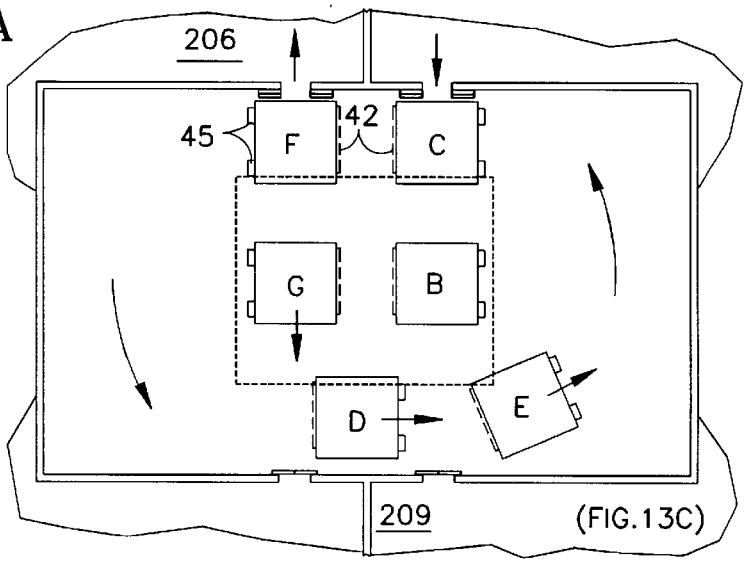
FIG. 14 is a series of views illustrating elevator cars moving above the passenger landing of FIG. 12.
Figure 14B:
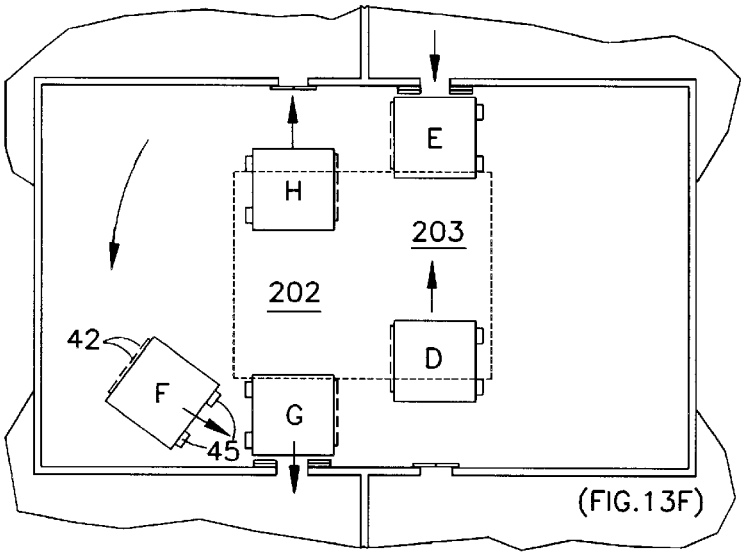
Figure 14C:
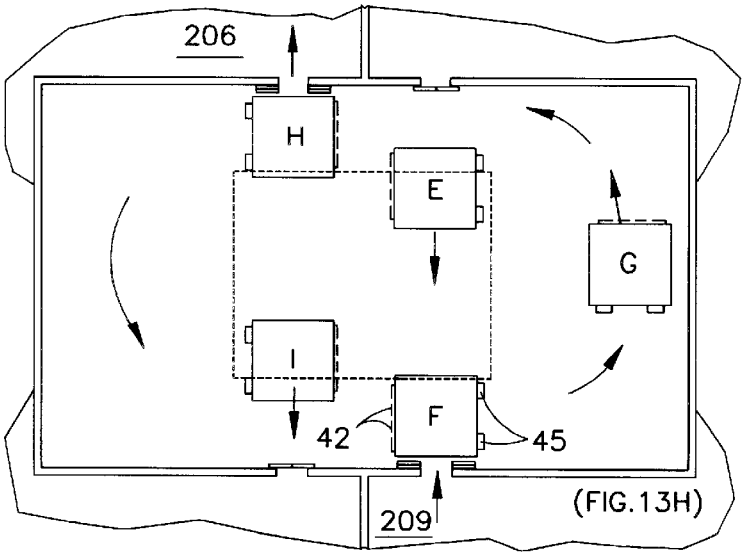

Referring to FIG. 13, illustration (a) shows a first time in which a first car, A, is about to be lowered in the down hoistway 203. (The cars designated A–J of FIG. 13 are not the same specific cars A–J of FIGS. 1–5). A second car, B, is loading passengers at the south loading lobby 209. A third car, C, is being moved from the south unloading lobby 208 beneath the east circular track 211 toward the north loading lobby 207, as a fourth car, D, is traveling beneath the west circular track 215 from the north unloading lobby 206 toward the south loading lobby 209. A fifth car E is unloading passengers at the south unloading lobby 208, and a sixth car, F, has just arrived in the up hoistway 202. In illustration (b), car B is moved toward the down hoistway as car C loads passengers, car D continues around the circular path and car E continues to offload passengers and car F is moved from the up hoistway toward the north unloading lobby. In illustration (c), car B is prepared to be lowered in the down hoistway as car C continues to load passengers, car E, now empty, moves from the south unloading lobby, through the south loading lobby onto the last circular path. Car D follows car E past the south unloading lobby toward the south loading lobby. The circular paths of FIG. 13 cause the cars to turn around, as shown in FIG. 14. Car F unloads passengers, and car G appears in the up hoistway, ready to be moved to the south unloading lobby, which was just vacated by car E. This operation continues as shown in illustrations (d)–(i).

To illustrate how the cars turn around at the upper landing 201, illustrations (a)–(c) of FIG. 14 show the orientation of car F as it travels from the north unloading lobby 206, around the west circular path, to the south loading lobby 209. Notice that in FIG. 14, (a), the coupling means 42 of car F are facing east, and because the car turns around as it traverses the circular path, the coupling means 42 are facing west in FIG. 14, (c).

In this embodiment, there are a total of six trolleys: two hoistway trolleys operate between the hoistways and the lobbies, and four trolleys (identified in FIG. 13 as K–N) operate between unloading lobbies and loading lobbies. In this embodiment, there are never more than two cars traveling between an unloading lobby and a loading lobby on the oval pathway beneath the tracks 211–218. Therefore, only four trolleys K–N are required on the oval path. The trolleys K–N become released each time a car reaches a unloading or loading lobby and is raised on the jacks 250, and the trolleys become engaged with a car whenever a car is finished unloading or loading at one of the unloading or loading lobbies. The trolleys K–N are, however, only shown during those periods of time when they are not engaged with a car; that is, when they are being positioned advantageously to be ready to pick up another car when that car finishes unloading. In each case, a trolley released at the north loading lobby will pick up a car at the south unloading lobby, and a trolley released at the south loading lobby will pick up a car at the north unloading lobby. As can be seen in FIG. 13, trolleys K and M are released at the north loading lobby and pick up a car at the south unloading lobby, whereas trolleys L and N are released at the south loading lobby and travel around to pick up cars at the north loading lobby, repetitively. It should be borne in mind that when a car is being held by the jacks, a trolley can pass over it without any interference whatsoever. And, when a trolley releases a car, it can remain above the car until another trolley with a car approaches. Thus, in illustrations (b) and (c) of FIG. 13, the trolley M can rest at the north loading lobby after releasing car C and then pass over car F as soon as the hoistway trolley that brought car F to the north unloading lobby has headed back toward the hoistway.

The manner of moving two cars at one time in each of two paths, from the up hoistways, past the unloading and loading lobbies, into the down hoistways can accommodate an arrival rate of one elevator car per each 15 seconds, allowing 17 or 18 seconds for unloading and an additional 17 or 18 seconds for loading, and utilizing approximately six seconds for each move. The move between a hoistway and a lobby can be made somewhat slower since they are relatively close to each other and there are passengers inside the car; the move between the unloading lobby and the loading lobby may be done at much higher speed without regard to passenger comfort because the car is empty at this time. Other timing arrangements may be made.

Figure 15:
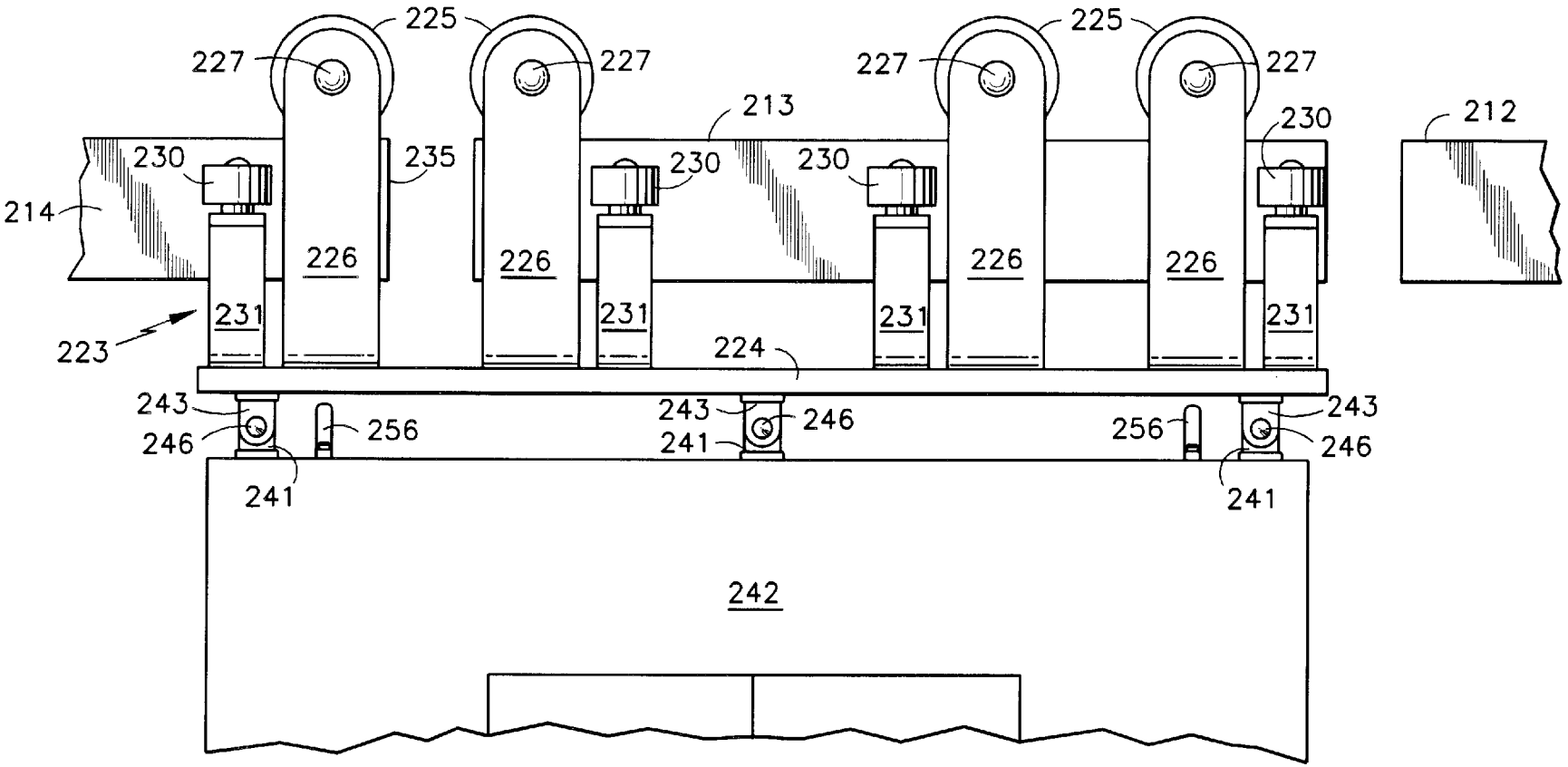
FIG. 15 is a partial, side elevation view of a trolley supporting an elevator car on the tracks of FIG. 14.
Figure 17:
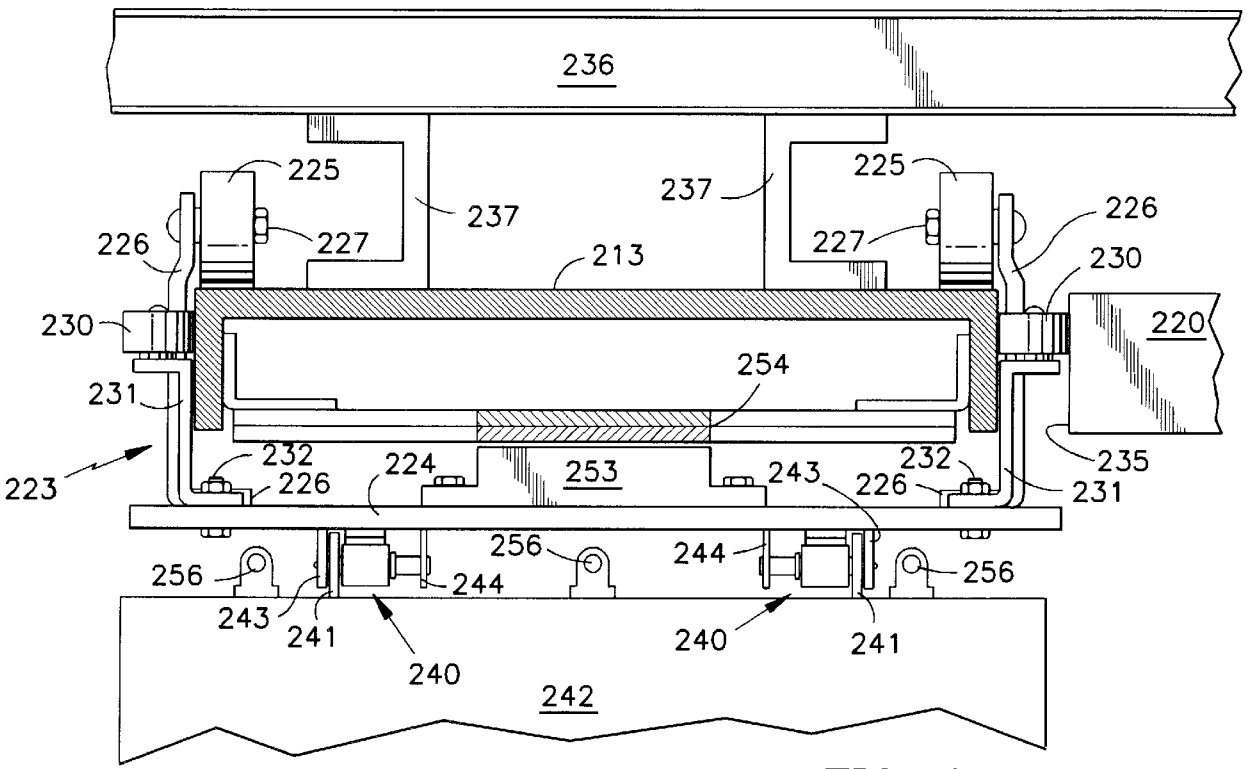
FIG. 17 is a partial, partially sectioned end elevation view of the trolley of FIG. 15 illustrating support of the tracks of FIG. 12.
Figure 16:
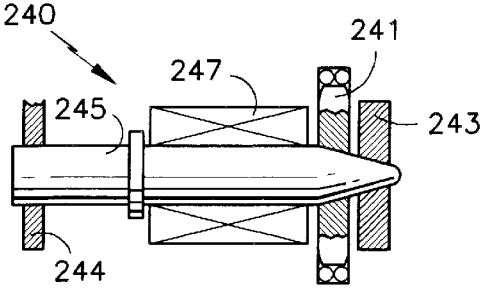
FIG. 16 is a sectional view of a lifting latch.

Referring to FIGS. 15–17, each trolley 223 comprises a main plate 224 which is suspended from eight wheels 225 by means of brackets 226 secured to the plate 224 by welding or bolts (not shown) or in any other suitable way. The wheels 225 are journaled to the brackets 226 in any suitable fashion, such as by means of threaded axles 227. The wheels 225 roll on top of opposite sides of the tracks 213, 214 (as well as track 215 when at the south unloading lobby). The trolley 223 is centered on the tracks 213–215 by means of eight guide rollers 230, four on each side, which are journaled to brackets 231 that are fastened to the plate 224 in any suitable fashion, such as by welding or by bolts 232. Each of the tracks 212–213 and 216–218 (FIG. 12) is separated from the corresponding adjacent tracks. The separations 235 allow passage of the brackets 226, 231 and the guide rolls 230 as a trolley passes onto one of the lobby segments 212, 214, 216, 218, in either of the two orthogonal directions of track shown in FIG. 12. The wheels 225 and rollers 230 are in pairs, spaced sufficiently to smoothly bridge the separations 235. The track 212 may correspond to the south loading lobby 209; the track 214, the south unloading lobby 208; the track 216, the north unloading lobby 206; and the track 218, the north loading lobby 207. Because each of the tracks 211–220 must be isolated to permit passage of the brackets and guide rollers, each of the tracks must be suspended from above (FIG. 17), such as by one or more I beams 236 or other suitable structure, by means of brackets 237 which may be fastened between the tracks 211–220 and the support structure 236 in any suitable way, such as by welding or bolts (not shown).

In FIG. 17, the trolleys K–M have, attached to the underside of their plates 224, six lifting latches 240 which cooperate with six corresponding lifting eyes 241 disposed on each of the elevator cars 242.

Figure 18:
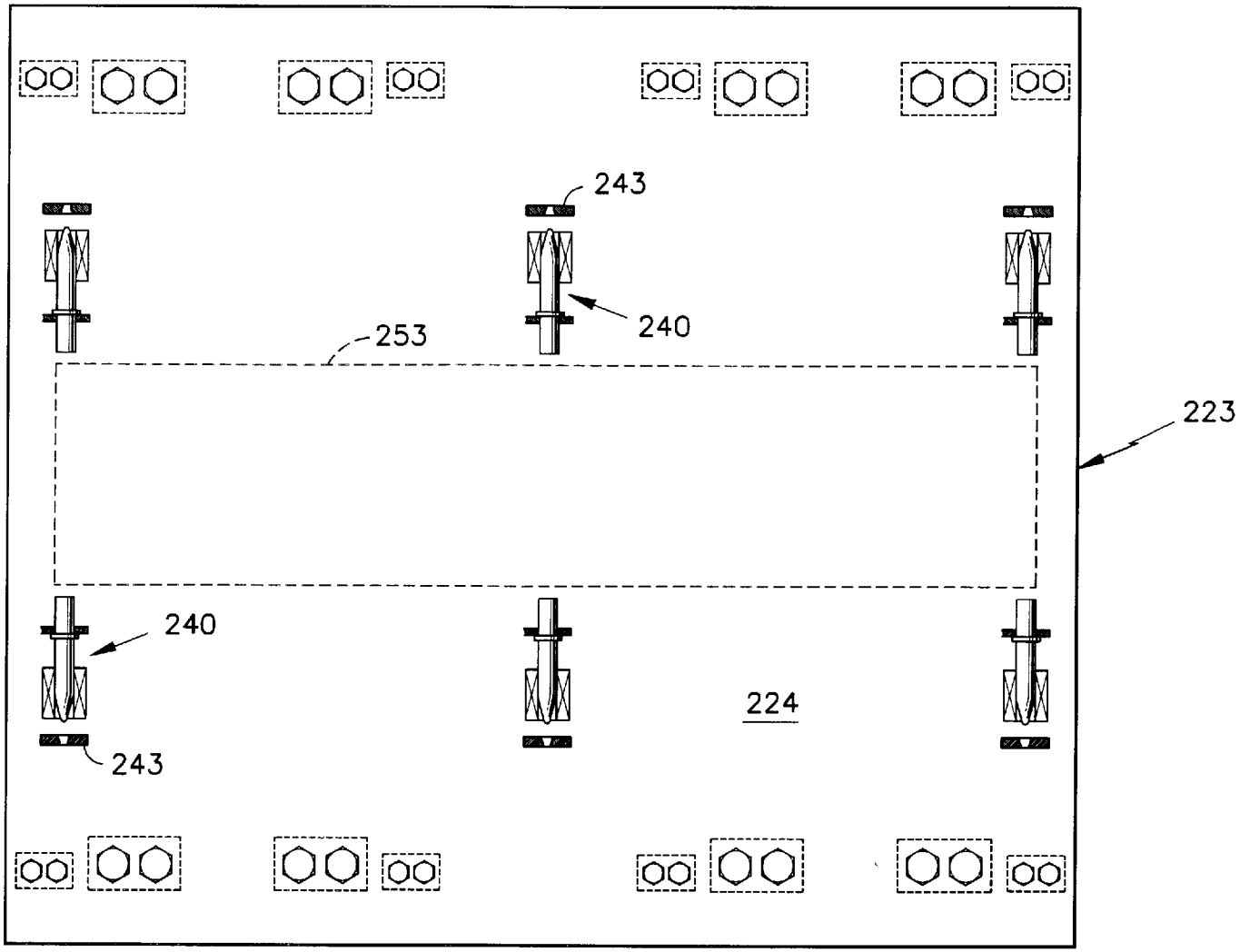
FIG. 18 is a bottom plan view of the trolley of FIGS. 15 and 17.
Figure 19:
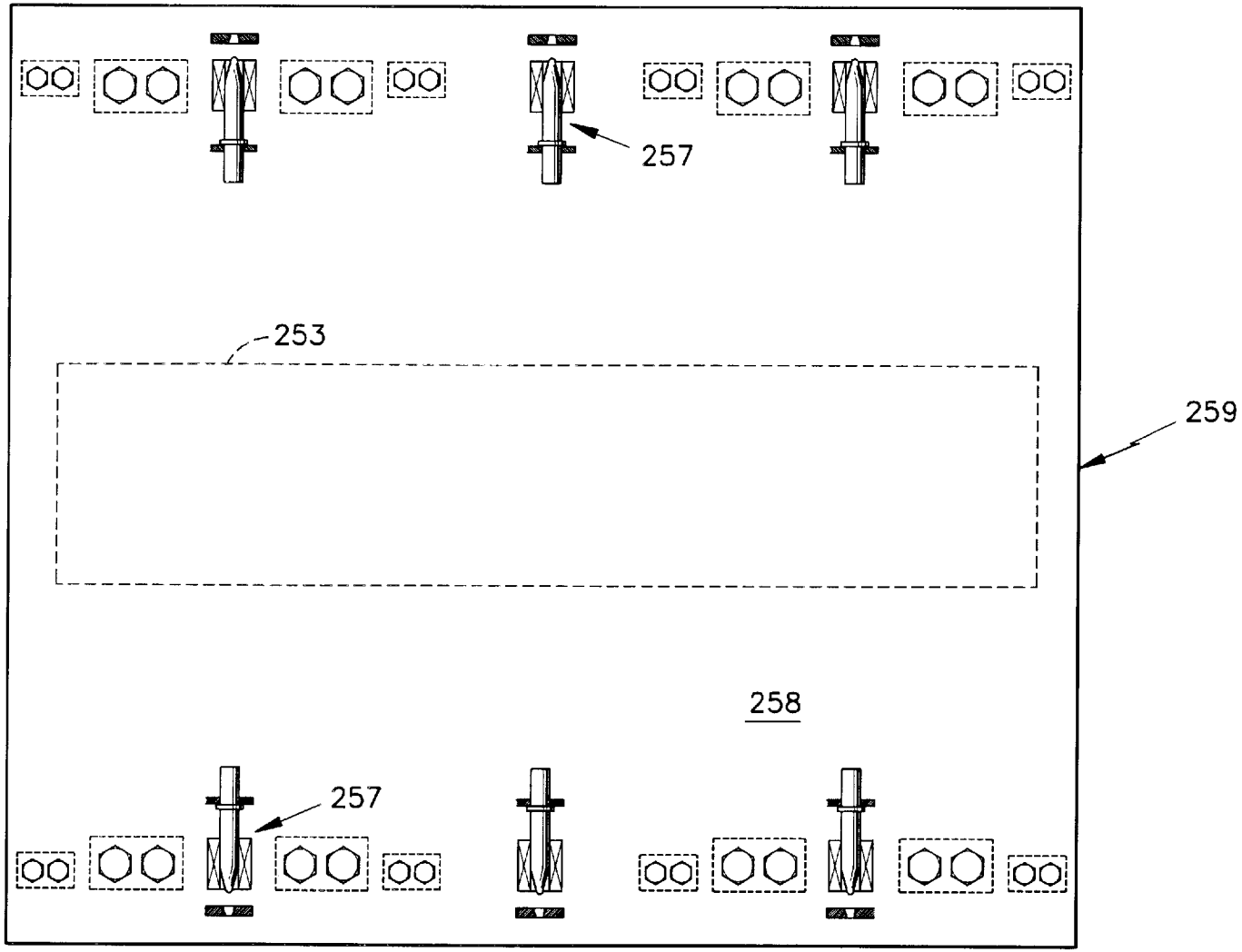
FIG. 19 is a bottom plan view of another trolley which supports elevator cars on the tracks of FIG. 14.

In FIG. 16, each lifting latch 240 comprises a pair of lifting rings 243, 244 and a bolt 245 which passes through holes 246 (FIG. 15) in each lifting ring. The lifting ring 244 acts as a guide as the bolt 45 transfers from the operative position shown in FIGS. 15–17 and an inoperative position shown in FIGS. 18 and 19. The lifting eyes 241, 243 are tapered so as to assure the capability for the bolt to strike them properly while at the same time causing the lifting of the elevator car 242 to be quite stable so as not to jostle the passengers in the car. The bolt 245 is moved between the operative and inoperative positions by DC current of a corresponding polarity in a solenoid 247, which acts against the north and south poles of the bolt 245, which is permanently magnetized with opposite poles at either end. Current of one polarity will cause the bolt 245 to advance to the operative position shown in FIG. 16, and removal of the current will cause the bolt to simply remain in that position. Current of the opposite polarity will cause the bolt to move to the left in FIG. 16, into the inoperative position as shown in FIGS. 18 and 19. With no current, the bolt simply remains where it has been placed last.

When a car has been moved to either an unloading lobby or a loading lobby by one of the trolleys 223 (or by a hoistway trolley 259, FIG. 19), a corresponding set of four jacks 250, which may be hydraulic, pneumatic, screw or any other form of jacks, will raise up slightly thereby stabilizing the elevator car so that passengers may exit or enter without the car shaking, and reducing somewhat the load on the lifting latches 240, thereby rendering it easier to retract the bolts 245 from the lifting rings 241, 243 (FIG. 16). Once the jacks 250 have been raised, then the trolley which brought the car to that position can be moved toward an unloading lobby or the up hoistway to pick up another elevator car which is resting on a corresponding set of jacks 250, or arriving at the up hoistway. For instance, with reference to illustration (a) of FIG. 13, the cars E and B are supported by the jacks 250, car D is moving from the north loading lobby to the south unloading lobby under the west circular track 215. Car C meantime is being moved from the south unloading lobby 208 to the north loading lobby 207 under the east circular track 211. Cars F and A are supported by corresponding up couplers and down couplers; the up hoistway trolley has engaged car F so that the coupler which brought it to the landing can now be disengaged. In illustration (b) of FIG. 13, car C has reached the north loading lobby 207 and is supported by the jacks 250; trolley M moves away. Trolley K and car D are waiting for car E to finish unloading; car B has been picked up by the down hoistway trolley and is being moved towards the down hoistway, as car F travels from the up hoistway to the north unloading lobby. In illustration (c) of FIG. 13, car E has been picked up by trolley K (not shown in FIG. 13, (c)) and cars E and D have passed the south unloading lobby. Trolley M has passed over car F as car F is held by the jacks for unloading. Trolley L, released in illustration (a), is getting ready to pass through the north loading lobby so as to be ready to pick up car F in illustration (d). This action continues as shown in illustrations (d)–(i) of FIG. 13.

As shown in FIG. 17, the trolley 223 is moved clockwise around the tracks 211–218 by means of a linear electric motor (LEM), including LEM primary windings 253 disposed on the upper side of the plate 224 and a LEM secondary 254 which is disposed under and within the tracks 211–218. The LEM is not illustrated in FIG. 15 for clarity. The general position of the LEM primary 253 is illustrated in FIGS. 18 and 19.

Figure 20:
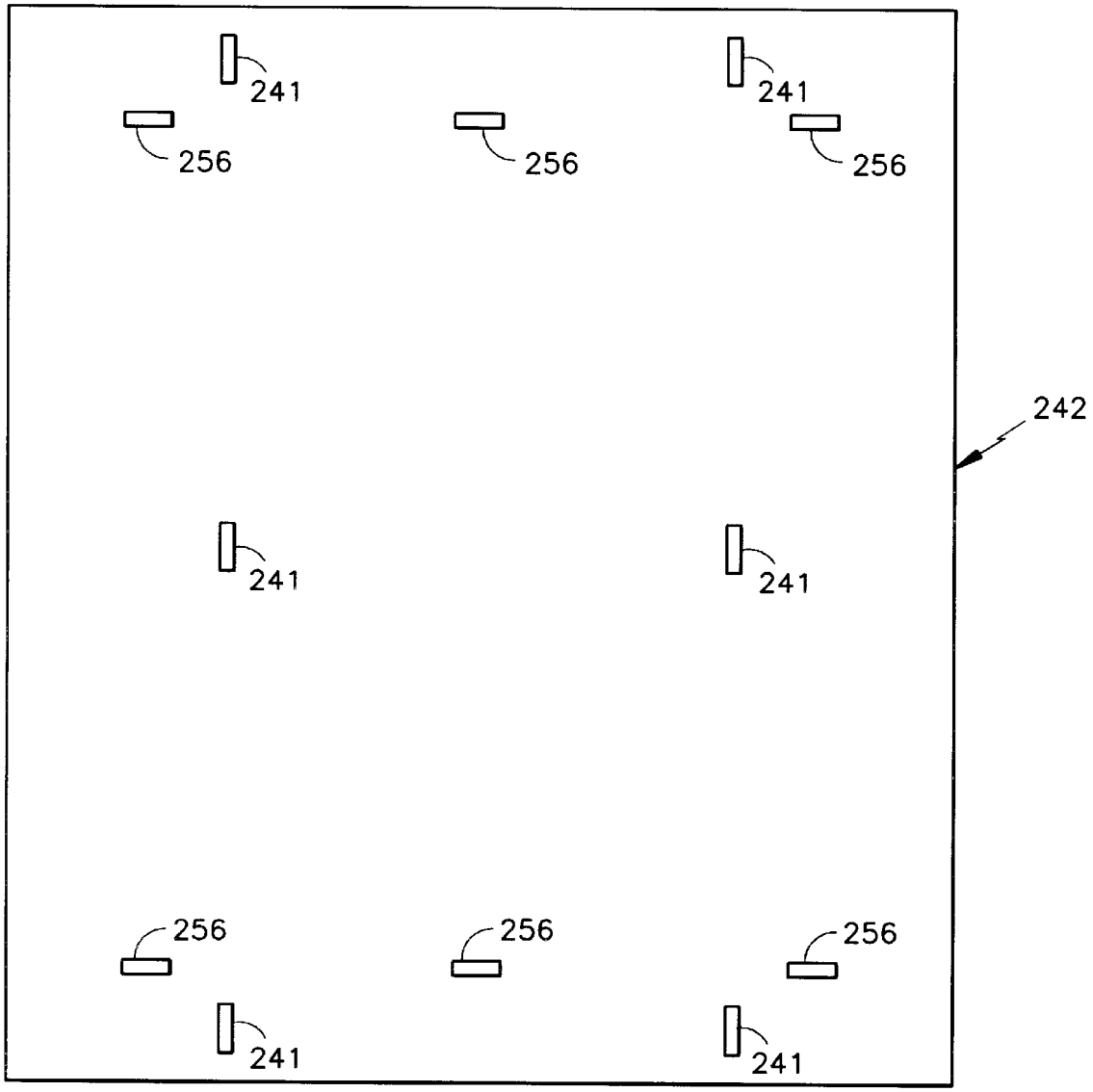
FIG. 20 is a simplified top plan view of an elevator car to be supported by the trolleys of FIGS. 18 and 19.

In order for the trolleys, such as trolley 223, to be able to travel around the oval path and for the hoistway trolleys to reach the lobbies without interference, it is necessary that the lifting rings 241, and similar lifting rings 256 (FIG. 20) used in conjunction with the hoistway trolleys, not interfere with the passage of the lifting latches 240, or of similar lifting latches 257 (FIG. 19) disposed on the bottom of the plate 258 of either of the hoistway trolleys 259. The two patterns illustrated in the bottom views of the oval trolleys 223 (FIG. 18) and hoistway trolleys 259 (FIG. 19) result in a pattern on each car (FIG. 20) of lifting eyes 241 for use in conjunction with the trolleys K–N and lifting eyes 256 for use in conjunction with the hoistway trolleys 259. Of course, other arrangements may be utilized if desired. Since the hoistway trolleys travel only short reciprocal distances, they may be powered by cables reaching from the overhead support structure. The oval trolleys may be powered by conventional power rails or, the trolleys must have passive secondaries and the tracks may have active primaries.

Figure 21:
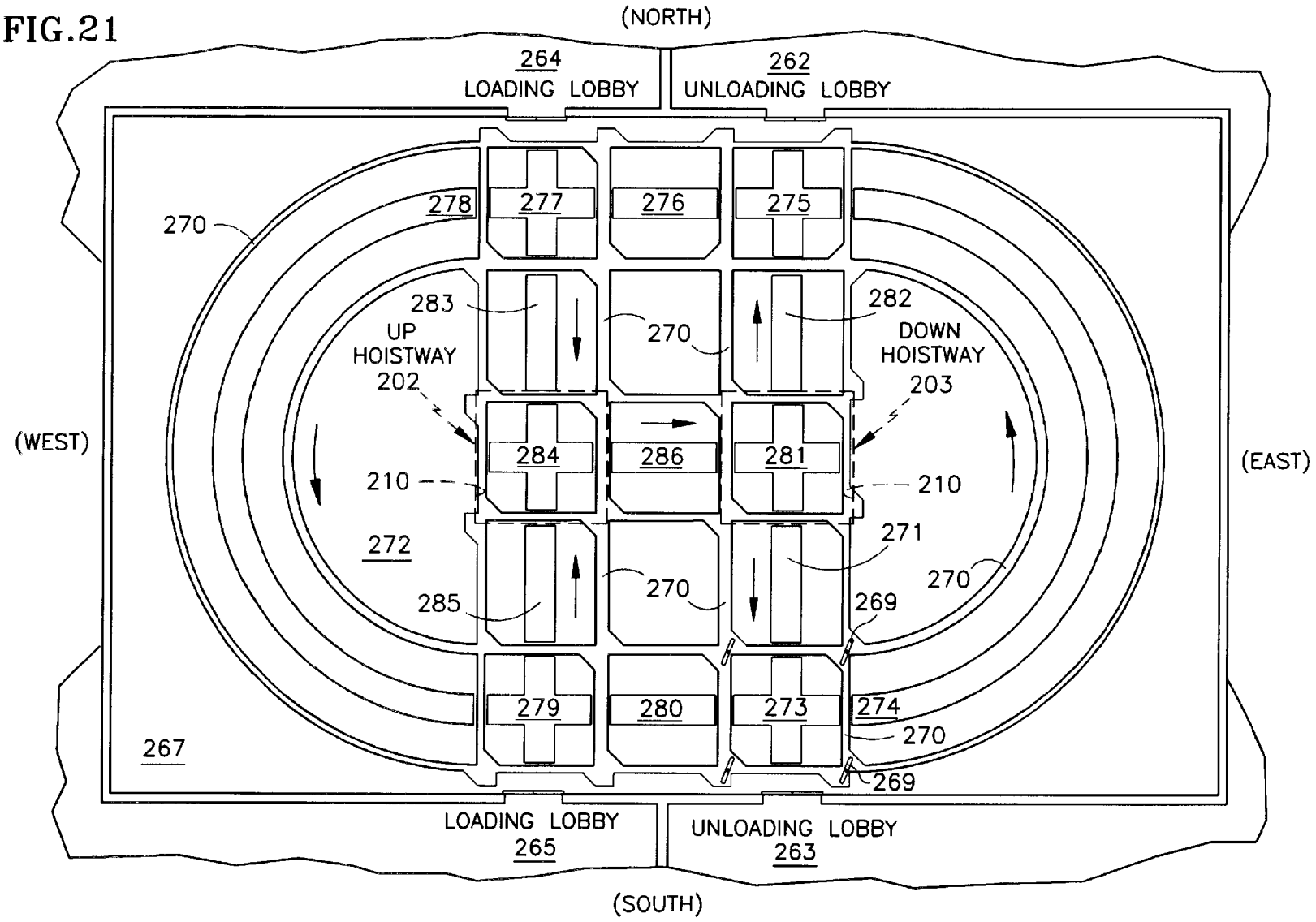
FIG. 21 is a partially sectioned top plan view of a lower passenger landing.

At the bottom of the hoistways, the situation is in a sense opposite from that at the top. It is possible to support things from underneath, but there can be no interference from above. In FIG. 21, elevator cars are received at a lower passenger landing 260 at the bottom end of the down hoistway 203, and they are moved to either a north unloading lobby 262 or a south unloading lobby 263 where the car doors are opened so that passengers may exit the car. Then each car is moved anti-clockwise from the south or north unloading lobby, past a south or north loading lobby to a corresponding north or south loading lobby 264, 265 where the doors are again opened so the passengers may enter the car. Thereafter, cars are moved to the up hoistway 202 for travel to the upper passenger landing of FIG. 12.

Figure 22:
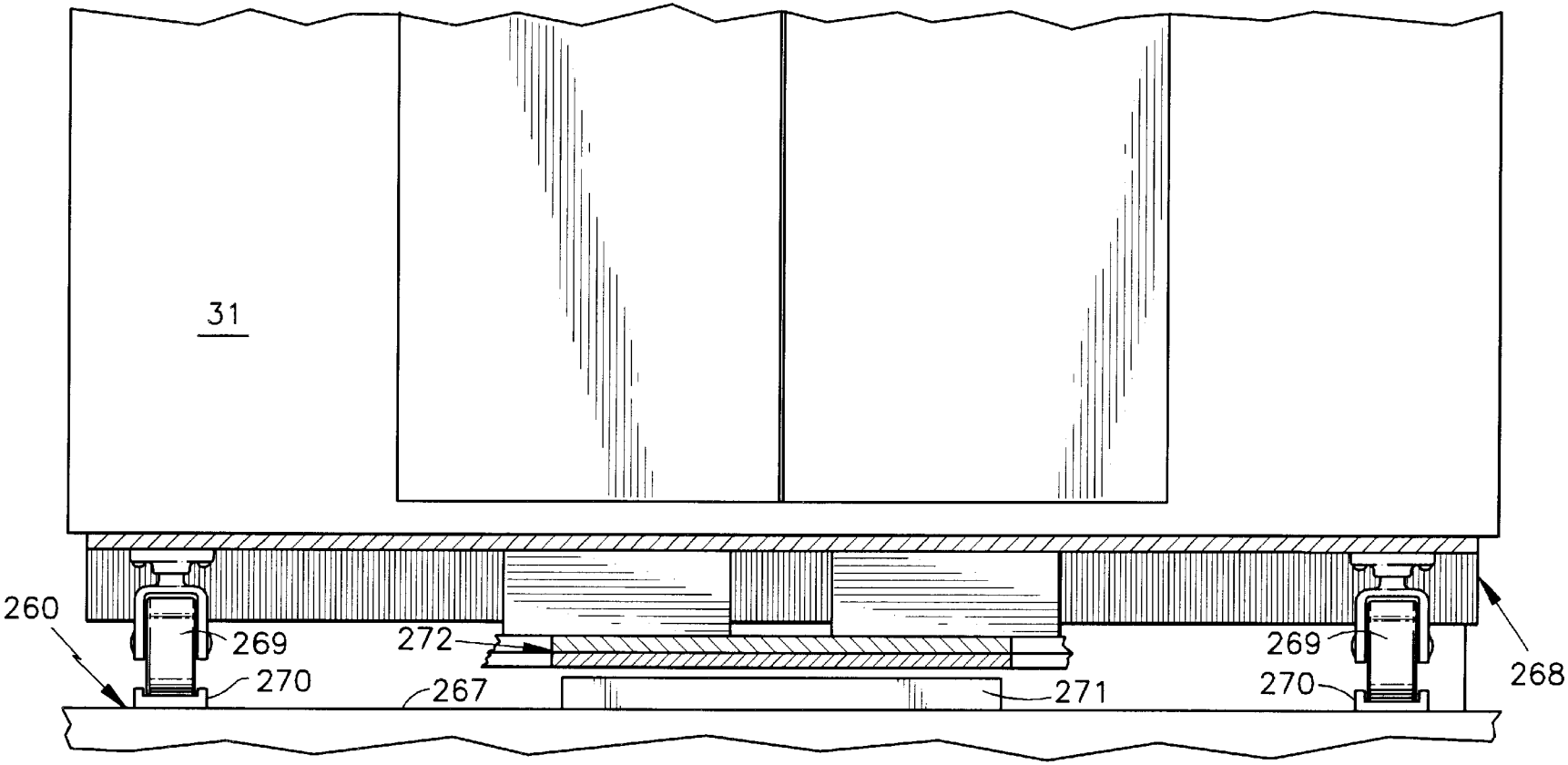
FIG. 22 is a partial front elevation view of an elevator car being supported by a dolly on the passenger landing of FIG. 21.

In this embodiment, each elevator car is lowered directly onto a dolly 268 (FIG. 22) which has casters 269 that roll in tracks 270 that define the path of movement of the dolly 268. The casters 269 are free to turn in any direction when urged to do so, in the known fashion. The dolly 268 is drawn along the tracks in a desired fashion by means of a LEM which includes the LEM primary 271 disposed on the floor 267 of the lower passenger landing, and T-shaped LEM secondaries 272 disposed beneath the dolly 268 in proximity with the primary 271. The LEM primary 271 is illustrated in FIG. 21 as being between the down hoistway 203 and the south unloading lobby 263. Other LEM primaries 273–280 provide an anti-clockwise path from the south unloading lobby 263 to the north loading lobby 264, and from the north unloading lobby 262 to the south loading lobby 265. Primaries 281, 282 provide a path from the down hoistway 203 to the north unloading lobby 262, and primaries 283–285 provide paths from the loading lobbies 264, 265 to the up hoistway 202. A primary 286 allows returning a dolly, after the car has been removed therefrom, from the up hoistway to the down hoistway so that it can service another car. Note that at the upper passenger landing, the jacks 250 relieved the lift latches on the trolleys so that the trolleys could be moved, and various trolleys successively to move each car. In the embodiment illustrated in FIG. 21, the dollies at the lower passenger landing receive a car and stay with that car until it is taken off the landing. Then the empty dolly is available for further use, so it will move beneath the down hoistway and wait for the next down car.

In FIG. 21, the tracks 270 at the south unloading lobby are shown with four casters 269 of a dolly therein. In each case, the casters will become aligned with the track in the direction of travel of the dolly and will remain so aligned when stopped. For instance, a dolly that moves from the down hoistway to the south unloading lobby has its casters initially aligned with the tracks leading from the down hoistway (north/south). As that dolly is forced to move to the left, its motion will be lateral to the alignment of the casters, but the shape of the intersection will cause the casters to drag into realignment with the tracks (east/west), as is illustrated in process for a dolly at the south unloading lobby 263. Use of LEM secondaries and simple casters provide a passive dolly that needs no power. Of course, other arrangements may be utilized to move elevator cars around in the lower passenger landing.

Of course, if desired, the casters and LEM secondaries may be disposed on the bottom of each car, thereby eliminating the need for the dollies.

In order for the cars to be removed from the hoistways, either by the trolleys at the upper passenger landing or by the dollies at the lower passenger landing, the guides, such as roller guides 45, that guide each car along the guide rails must be released from the guide rails in a manner to allow the car to slide sideways without interference between the guide rails and the roller guides. In this embodiment, it is assumed that the guide rails 44 extend upwardly and downwardly just as far as is necessary to guide the car until it comes to a stop at the point where it will either be picked up by a trolley or is resting on a dolly. In order to clear the rails, the roller guides are raised above the end of the rails when at the upper passenger landing and are lowered beyond the bottom of the rails when at the lower passenger landing.

Figure 23:
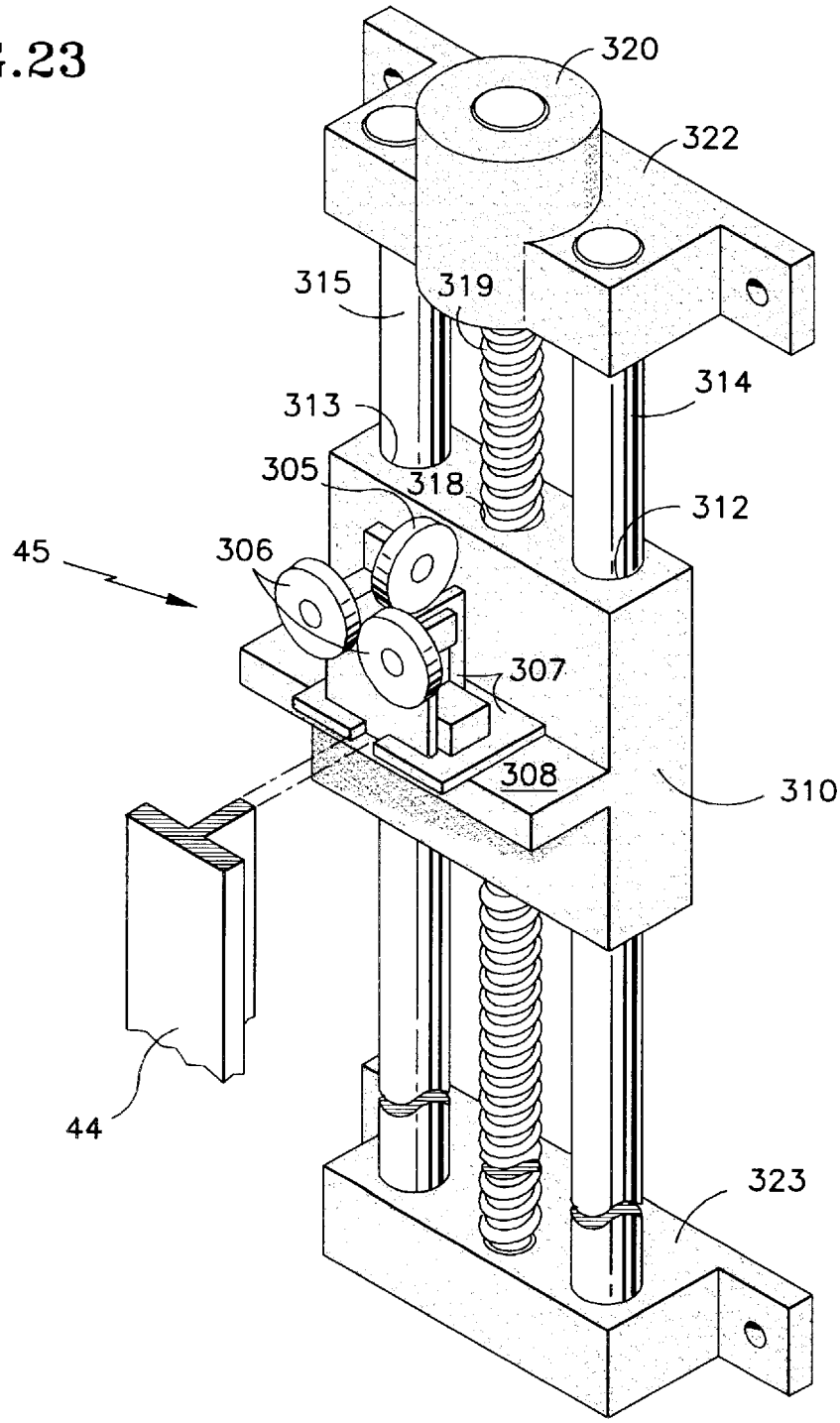
FIG. 23 is a simplified, partially sectioned and broken away perspective view of a releasable roller guide assembly.

In FIG. 23, a releasable roller guide 45 includes a postwise roller 305, and two side rollers 306, of a conventional sort. The rollers 305, 306 are mounted on conventional adjusting bracket assembly 307 which in turn is disposed on a shelf 308 of a moveable block 310. A small section of guide rail 44 is shown displaced to the left from where it would engage the rollers 305, 306 when in use. The block has two clearance holes 312, 313 for corresponding rods 314, 315 that guide the moveable block 310. The block has a threaded hole 318 that receives a screw or worm gear 319 which can be turned by a motor 320 whenever the guides 305, 306 are to be adjusted upwardly or downwardly. The motor 320 is formed within an upper support 322, and the lower end of the screw 319 is journaled in a lower support block 323. The guide rods 314, 315 are positioned by the upper and lower support blocks 322, 323. The blocks 322 and 323 may be disposed on the side of the elevator opposite to the coupling means 42. When the elevator is to be run in the hoistway, the block 310 is centered vertically between the supports 322 and 323. At the upper passenger landing, once the car has been engaged by a trolley, the block 310 is moved to its extreme upward position, by operation of the motor 320 which turns the screw 319 thereby moving the block 310, where the rollers 305, 306 and assembly 307 clear the top of the guide rail so that the car may be translated in a direction parallel to the two guide rails (north or south in the landings). In this embodiment, it is assumed preferable to mount the releasable roller guides 45 along the vertical midpoint of the side of the elevator car to provide the greatest resistive support for the engagement, coupling, and disengagement of the car by the couplers. On the other hand, if desired, the releasable roller guides 45 may be disposed near the top of the elevator car side so as to provide the greatest resistance to the torque moment created as a result of the couplers supporting the car wholly on the opposite side from the roller guides. Of course, other arrangements may be made. Whenever the car has been lowered to the point where it is being supported by a dolly at the lower passenger landing, the motor 320 can turn a the screw 319 in a direction so as to drive the block 310 downwardly so that the guides 305, 306 and assembly 307 will clear the bottom of the guide rail as the car is moved laterally into the landing.

In FIG. 1, segments Q, S and U are idle; segments P, R and T are moving cars. Similarly, in FIG. 3, segments P, R and T are idle while segments Q, S and U are moving cars. The segments may be long segments, such as eighty or more stories. This results in less than maximal use of the elevator core space of the building in moving cars upwardly and downwardly therein.

A second embodiment of the invention will maximize utilization of the elevator core space by eliminating every other one of the segments (such as segment Q) shown in FIGS. 1–5 and substituting therefor a closed rope loop having two couplers on it which acts as a shuttle to move the cars from one of the segments, such as segment P, to the next segment, such as segment R, in the same fashion as does the segment Q in FIGS. 1–5.

Figure 24:
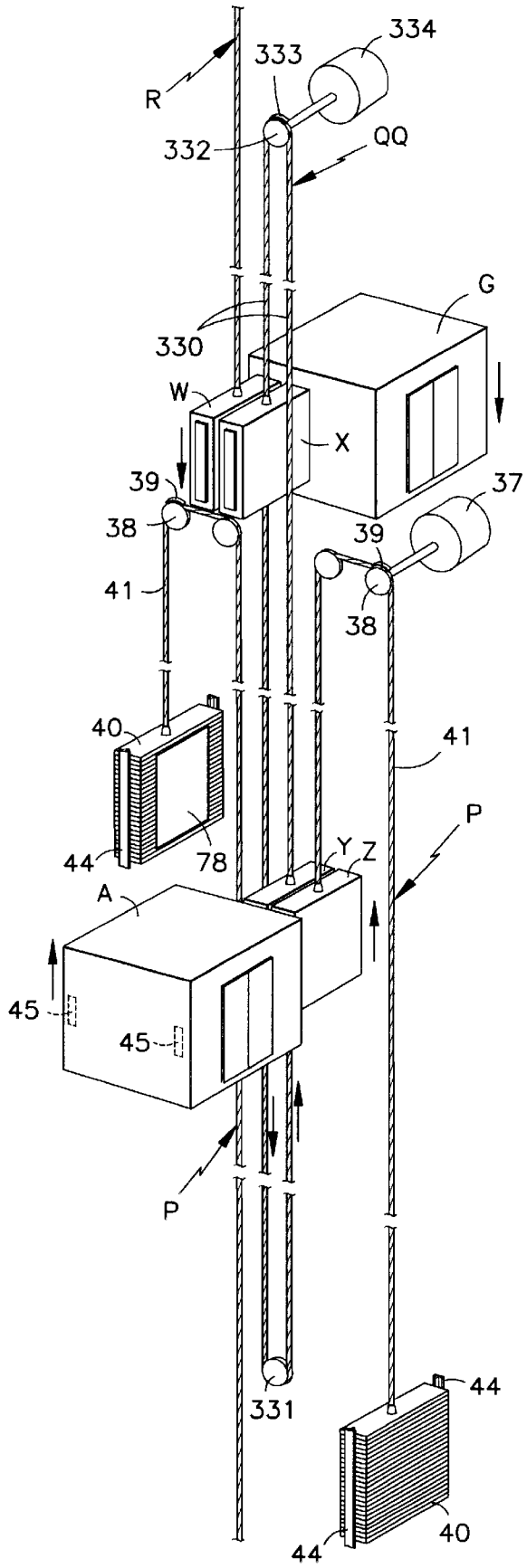
FIG. 24 is a simplified perspective view of an alternative embodiment of the invention, as in the two lowermost portions of FIG. 2.

Referring now to FIG. 24, a closed rope loop 300 has the couplers X and Y secured thereto to form a segment QQ which can be substituted for the segment Q. The rope loop 330 is disposed about an idle sheave 331 and a drive sheave 332 which, with a conventional brake and motor 333, 334 forms a conventional elevator traction machine to drive the loop 330. Other than being connected to the rope loop 330, the couplers X and Y are identical to those in the previous embodiments, as is illustrated in FIG. 24. Notice that the X and Y couplers of each loop 300 will not interfere with the W and Z couplers roped to the counterweights due to the horizontal displacement shown in FIGS. 24 and 25. At the moment depicted in FIG. 24, the loop is traveling anticlockwise as shown, so that the coupler Y is traveling upwardly, moving cab A upwardly, and the coupler X is traveling downwardly moving cab G downwardly. In the moment just preceding the point in time depicted in FIG. 24, the couplers X and Y were being accelerated from a rest position so as to achieve synchronism with the cars G and A, respectively, before being engaged thereto. In the next moment of time, couplers W and Z will be disengaged from cabs G and A, respectively and both couplers will be decelerated to a stop.

Figure 25:
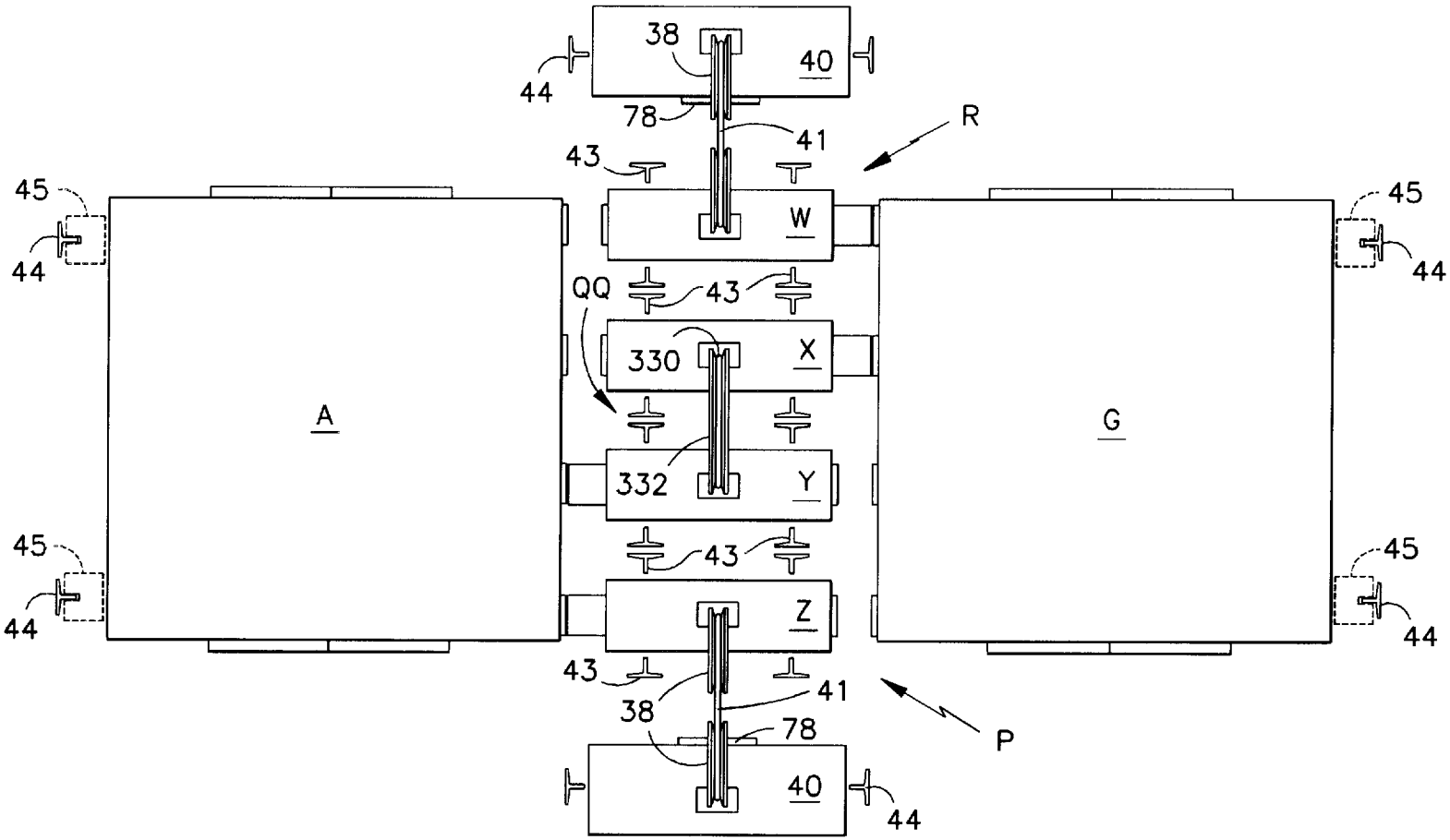
FIG. 25 is a top plan view of the embodiment of FIG. 24.

As an example, if the cars A, G are moving at a speed of about ten meters per second, then deceleration of the roped counterweights and couplers W, Z is accomplished at about ten meters per second per second (gravity) the couplers W, Z will decelerate to a stop in about one second. To accelerate in the opposite direction to a speed of about ten meters per second, at the same rate of acceleration of about ten meters per second per second, will take about an additional second. Thus, in this example, the couplers X, Y will be carrying the cars G, A for a minimum of two seconds. At ten meters per second, this requires a twenty meter length of the loop 300. But in addition, the loop must be long enough to allow the couplers X and Y to decelerate to a stop and to accelerate in the opposite direction to carry the next cars in turn. The deceleration at ten meters per second per second from velocity of ten meters per second only requires five meters of space. Thus, there needs to be five meters above and below the twenty meters required for carrying the cars. The useful, working length of travel with the couplers X and Y, in this example, would therefore be about twenty-five meters (or perhaps slightly longer to assure the length is adequate). Assuming that the roped counterweight couplers W and Z travel over much greater distances than 30 meters (which of course they will) the couplers X and Y will remain at rest for some period of time waiting for another pair of cars to approach, before they will accelerate so as to become synchronized with the approaching cars to be engaged therewith. In the embodiment of FIGS. 24 and 25, the only time that the couplers W, Z are not actually moving the cars is when they are decelerating and accelerating at the end and beginning of each run. Therefore, by using a significant number of roped counterweight segments, the utilization of the elevator core space can be maximized by having more cars traveling in the up hoistway and in the down hoistway at all times.

Figure 6:
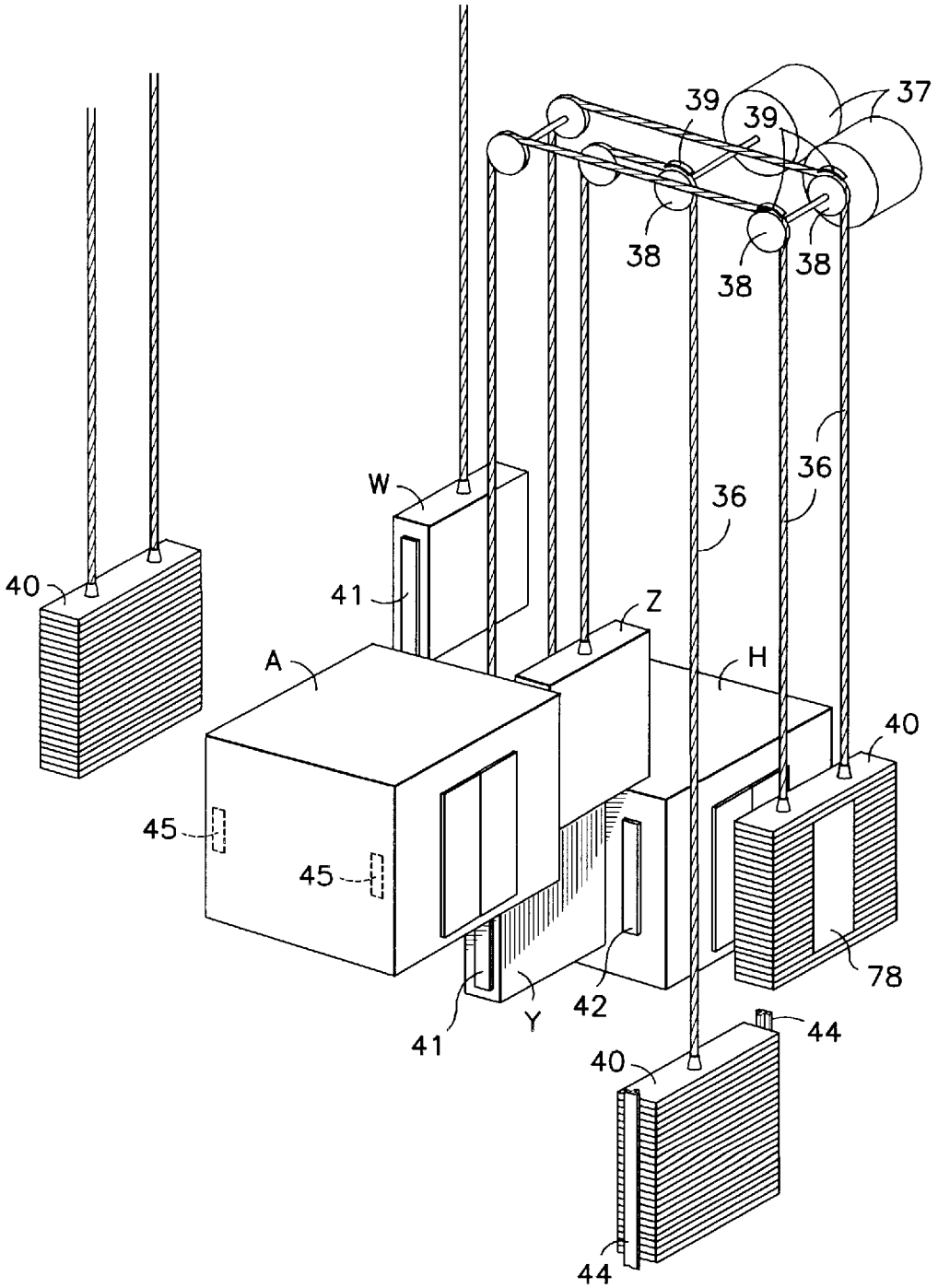
FIG. 6 is a simplified perspective view of a pair of elevator cars passing each other, as in the lowermost portion of FIG. 1.
Figure 7:
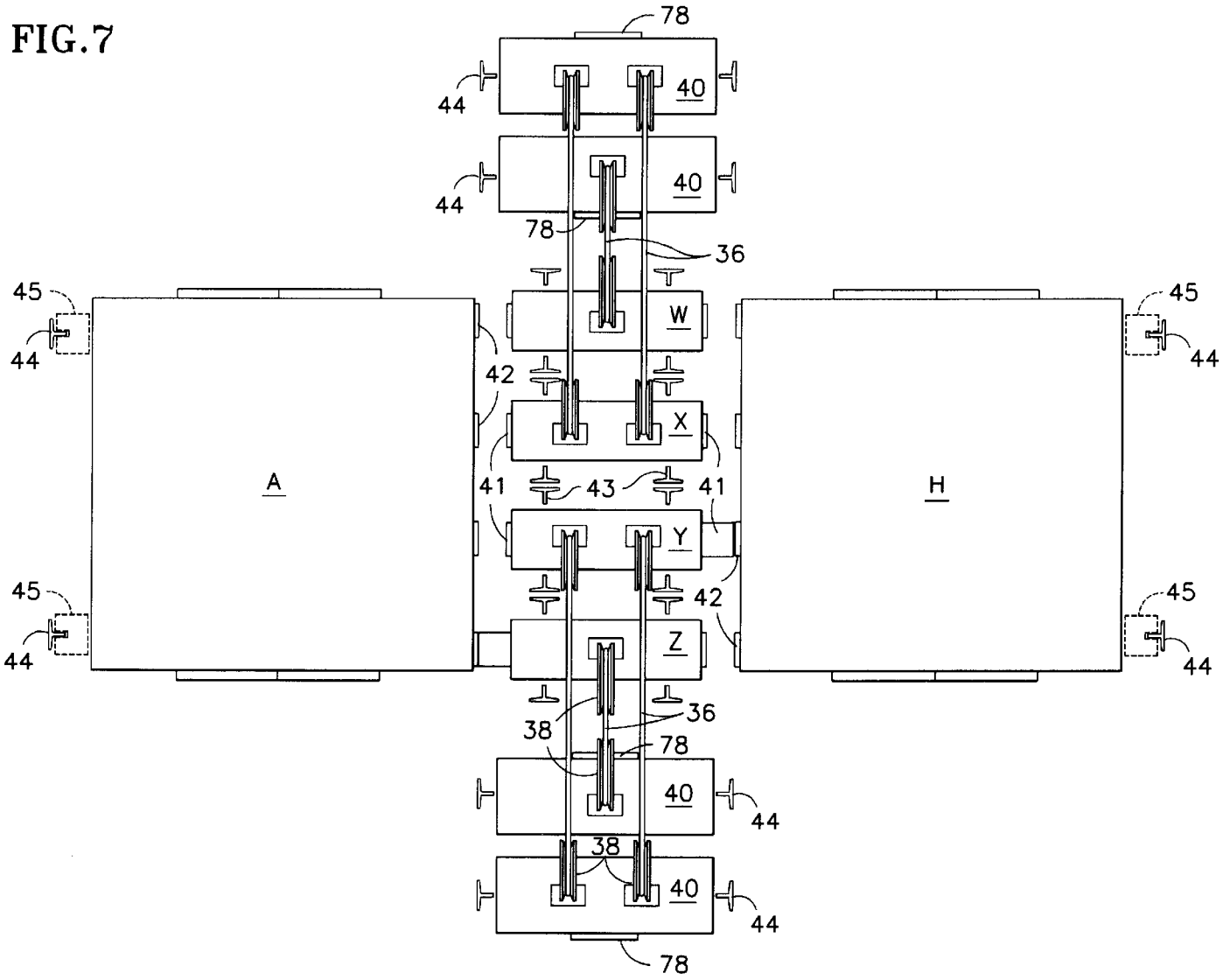
FIG. 7 is a top plan view of the hoisting systems and passing elevator cars of FIGS. 1 and 6.
Figures 26A, 26B, 26C, 26D, 26E, 26F:
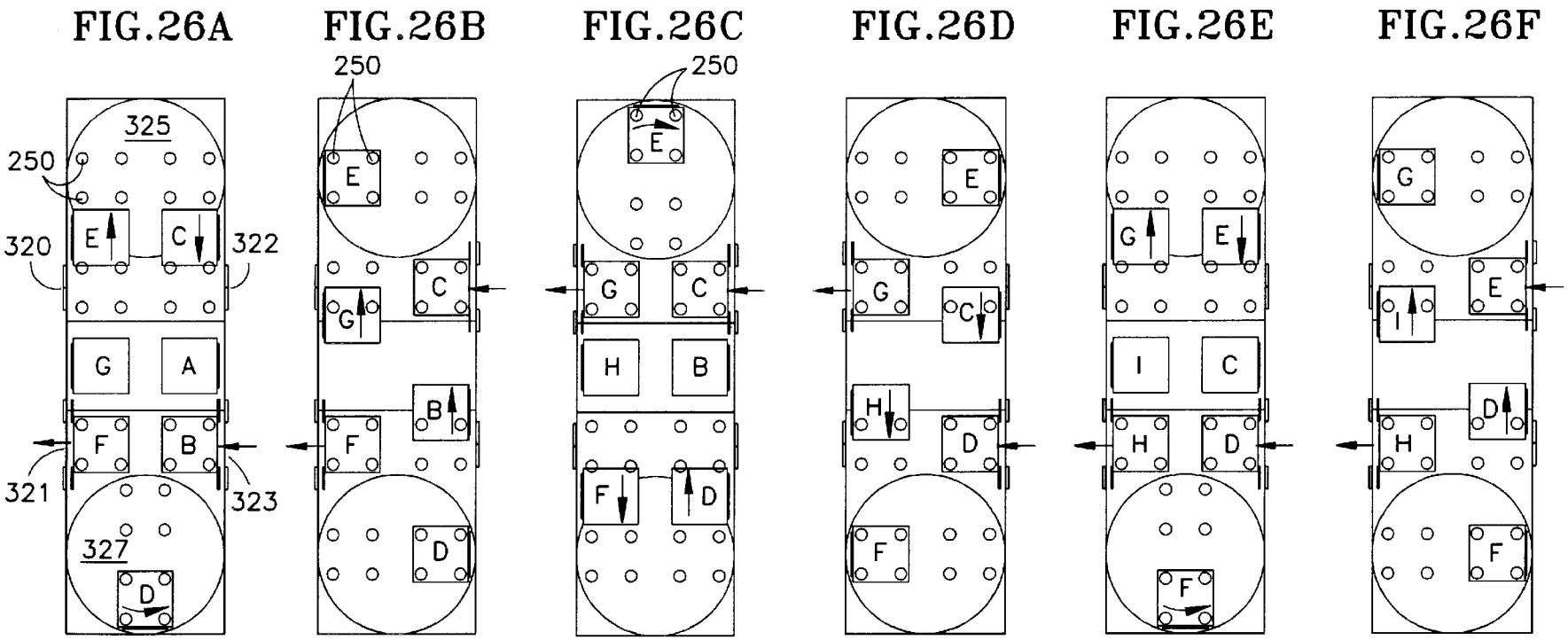
FIG. 26 is a series of illustrations of an alternative landing and how the cars may proceed through it.

In the foregoing embodiments, the elevator car doors are on the front and back of the car, as seen in FIG. 6. However, if desired, there is ample room for elevator doors on the side of each car opposite to the couplers (approximately where the numeral 45 is seen in FIG. 6). If the elevators have a single set of doors on the side of the car, then a different sort of landing can be used, as is illustrated in FIG. 26. This is very similar to the landing of FIG. 12, except that the unloading lobbies 320, 321 and loading lobbies 322, 323 are on the sides rather than the ends of the landing area, and carrousels 325, 327 may be used for turning the car around, while supported on jacks 250 as seen in illustrations (a)–(c) of FIG. 26. Other configurations for landings may be used if desired.

The couplers may be fashioned like those couplers fashioned like the lifting latches herein, or otherwise, if desired.

The invention may be used with multideck cars. All of the aforementioned copending applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system comprising:

a plurality of segments, each segment comprising a rope, a coupler connected to said rope, and an elevator traction machine for selectively driving said rope in opposite directions so as to move said coupler upwardly and downwardly along a vertical path in said segment, the lower end of the vertical path of each of said segments except the lowest segment in said system overlapping with the upper end of the vertical path of another one of said segments, the upper end of the vertical path of each of said segments except the highest segment in said system overlapping with the lower end of another one of said segments;

a plurality of elevator cars, the number of said elevator cars traveling in said segments at any one time being equal or greater than to the number of said segments, each of said cars and each of said couplers having mutually complementary coupling means which are selectively engageable so that, when engaged, the corresponding coupler will raise or lower the related car, and when disengaged, said couplers will pass said cars along said paths without interference; and means for selectively bringing the coupling means of each of said couplers into engagement with the coupling means of any one of said cars adjacent thereto and for selectively disengaging said coupling means of said couplers from the coupling means of said cars.

2. An elevator system according to claim 1 wherein:

each of said couplers travels upwardly and downwardly in a corresponding one of four adjacent parallel paths, each of said couplers having said coupling means on each of two opposite ends thereof, said elevator cars traveling upwardly in an up hoistway which is adjacent to the coupling means at a first end of said couplers, said cars traveling downwardly in a down hoistway adjacent said coupling means on an end of said couplers opposite to said first end so that each of said couplers may become coupled to and thereby propel one of said cars in a first direction in one of said hoistways, and immediately thereafter, change direction and become coupled to another one of said cars in the other of said hoistways so as to propel said another car in a direction opposite to said first direction.

3. An elevator system according to claim 2 comprising:

N of said segments, where N is an odd number greater than one, the lowest of said segments, the highest of said segments, and every odd numbered segment in between comprising a counterweight connected to an end of the corresponding rope opposite to the end of such rope to which the related coupler is connected; and the remaining ones of said segments comprising a closed rope loop having two couplers disposed in functionally opposite positions on said rope so that as one of said two couplers engages or disengages a car traveling in a first of said directions in one of said hoistways, the other one of said two couplers will substantially simultaneously engage or disengage, respectively, another one of said cars traveling in the opposite one of said directions in the other of said hoistways.

4. An elevator system according to claim 2 comprising:

means for removing cars from the top of said up hoistway, changing passenger loads, and returning cars to the top of said down hoistway; and means for removing cars from the bottom of said down hoistway, changing passenger loads, and returning cars to the bottom of said up hoistway.

5. An elevator system according to claim 1, wherein:

each of said segments comprising two ropes, a coupler connected to each of said ropes, and a pair of elevator traction machines, one for driving each of said ropes, said traction machines driving said two ropes in mutually opposite directions so as to move said couplers upwardly and downwardly along a vertical path in said segment, the couplers in each segment traveling in mutually adjacent paths, each of said ropes having a counterweight connected thereto at an end thereof opposite to an end to which the related coupler is connected.

6. An elevator system comprising:

a plurality of segments, each of said segments comprising two ropes, a coupler connected to each of said ropes, and a pair of elevator traction machines, one for driving each of said ropes, said traction machines driving said two ropes in mutually opposite directions so as to move said couplers upwardly and downwardly along a vertical path in said segment, the couplers in each segment traveling in mutually adjacent paths, each of said ropes having a counterweight connected thereto at an end thereof opposite to an end to which the related coupler is connected, the lower end of the vertical path of each of said segments except the lowest segment in said system overlapping with the upper end of the vertical path of another one of said segments, the upper end of the vertical path of each of said segments except the highest segment in said system overlapping with the lower end of another one of said segments;

a plurality of elevator cars, the number of said elevator cars traveling in said segments at any one time being equal or greater than the number of said segments, each of said cars and each of said couplers having mutually complementary coupling means which are selectively engageable so that, when engaged, the corresponding coupler will raise or lower the related car, and when disengaged, said couplers will pass said cars along said paths without interference;

means for selectively bringing the coupling means of each of said couplers into engagement with the coupling means of any one of said cars adjacent thereto and for selectively disengaging said coupling means of said couplers from the coupling means of said cars;

a plurality of spring buffers, one for each counterweight, each having a latch, each spring buffer being within the vertical path of the related counterweight at the low end of said counterweight's vertical path, each spring buffer having a spring which is distorted by the weight of said counterweight as said counterweight travels downwardly in its vertical path, said latch capturing said spring in substantially its maximum distorted condition to maintain it in said distorted condition, each including means for releasing said latch so as to release said spring buffer when said counterweight is to accelerate upwardly; and a linear electric motor including a primary type portion and a secondary type portion, one of a first type of said portions being disposed in said hoistway adjacent a portion of the counterweight's vertical path at the low end of said counterweight's vertical path, and one of a second type of said portions being disposed on said counterweight so as to coact with said first type of portion when said counterweight is adjacent said first type of portion.

7. A buffer for decelerating and accelerating an elevator counterweight in an elevator system having a selectively engageable car coupler roped through a traction machine to said counterweight, comprising:

a spring buffer having a latch, said spring buffer being within the counterweight's vertical path at the low end of said counterweight's vertical path, said spring buffer having a spring which is distorted by the weight of said counterweight as said counterweight travels downwardly in its vertical path, said latch capturing said spring in its maximum distorted condition to maintain it in said condition; and means for releasing said latch so as to release said spring buffer when said counterweight is to accelerate upwardly.

8. A buffer for decelerating and accelerating an elevator counterweight in an elevator system having a selectively engageable car coupler roped through a traction machine to said counterweight, comprising:

a linear electric motor including a primary type portion and a secondary type portion, one of a first type of said portions being disposed in said hoistway adjacent a portion of the counterweight's vertical path at the low end of said counterweight's vertical path, and one of a second type of said portions being disposed on said counterweight so as to coact with said first type of portion when said counterweight is adjacent said first type of portion.

* * * * *